US007494551B2

(12) United States Patent
Yazawa et al.

(10) Patent No.: US 7,494,551 B2
(45) Date of Patent: Feb. 24, 2009

(54) FERRITIC STAINLESS STEEL PLATE WITH TI AND METHOD FOR PRODUCTION THEREOF

(75) Inventors: Yoshihiro Yazawa, Chiyoda-ku (JP); Osamu Furukimi, Chiyoda-ku (JP); Yasushi Kato, Chiyoda-ku (JP)

(73) Assignee: JFE Steel Corporation (JP)

( * ) Notice: Subject to any disclaimer, the term of this patent is extended or adjusted under 35 U.S.C. 154(b) by 210 days.

(21) Appl. No.: 10/517,886

(22) PCT Filed: Jun. 16, 2003

(86) PCT No.: PCT/JP03/07621

§ 371 (c)(1),
(2), (4) Date: Dec. 13, 2004

(87) PCT Pub. No.: WO03/106725

PCT Pub. Date: Dec. 24, 2003

(65) Prior Publication Data

US 2005/0173033 A1 Aug. 11, 2005

(30) Foreign Application Priority Data

Jun. 17, 2002 (JP) ..... 2002-175667
Jul. 4, 2002 (JP) ..... 2002-195763

(51) Int. Cl.
*C22C 38/28* (2006.01)
*C21D 8/02* (2006.01)

(52) U.S. Cl. ..... 148/326; 148/325; 148/608; 148/609; 148/610

(58) Field of Classification Search ..... 148/326, 148/325, 608–610; 420/70
See application file for complete search history.

(56) References Cited

U.S. PATENT DOCUMENTS 5,685,923 A 11/1997 Takata et al.
6,855,213 B2 * 2/2005 Yoshitake et al. ..... 148/325

FOREIGN PATENT DOCUMENTS

| | | | |
|---|---|---|---|
| EP | 1 386 977 A-1 | | 2/2004 |
| JP | 9-137231 | | 5/1995 |
| JP | 7-233449 | A | 9/1995 |
| JP | 9-227999 | | 2/1997 |
| JP | 9-235621 | A | 9/1997 |
| JP | 9-256065 | A | 9/1997 |
| JP | 10-130786 | | 5/1998 |
| JP | 2000-336462 | * | 12/2000 |

* cited by examiner

*Primary Examiner*—Deborah Yee
(74) *Attorney, Agent, or Firm*—DLA Piper LLP (US)

(57) ABSTRACT

A Ti-containing ferritic stainless steel sheet and a manufacturing method thereof include stainless steels being formed while a refining load is decreased and having a low yield strength which exhibits superior workability. The Ti-containing ferritic stainless steel sheet contains on mass percent basis: 0.01% or less of C; 0.5% or less of Si; 0.3% or less of Mn; 0.01% to 0.04% of P; 0.01% or less of S; 8% to 30% of Cr; 1.0% or less of Al; 0.05% to 0.5% of Ti; 0.04% or less of N, $8 \leqq Ti/(C+N) \leqq 30$ being satisfied; and the balance being substantially Fe and incidental impurities, wherein a grain size number of ferrite grain is 6.0 or more, and an average diameter Dp of precipitation diameters, each being [(a long axis length of a Ti base precipitate+a short axis length thereof)/2], of the Ti base precipitates in the steel sheet is in the range of from 0.05 μm to 1.0 μm.

11 Claims, 4 Drawing Sheets

0.1 μm 0.1 μm 0.1 μm

FERRITIC STAINLESS STEEL PLATE WITH TI AND METHOD FOR PRODUCTION THEREOF

TECHNICAL FIELD

The present invention relates to Ti-containing ferritic stainless steel sheets having a low yield strength which exhibits superior workability and to manufacturing methods thereof. In particular, the present invention relates to hot rolled and cold rolled Ti-containing ferritic stainless steel sheets and manufacturing methods thereof, each ferritic stainless steel sheet having a structure made of fine grains and a low yield strength which exhibits superior workability preferably used for applications in which a high r value and high ductility are required.

BACKGROUND ART

As methods for improving the workability of ferritic stainless steel sheets, for example, a method has been disclosed in Japanese Unexamined Patent Application Publication No. 3-264652 in which Ti or Nb is added besides reduction of C and N. In addition, in Japanese Unexamined Patent Application Publication No. 5-320772, as methods for manufacturing a more inexpensive Ti-containing ferritic stainless steel sheet, a manufacturing method has been disclosed in which besides hot rolling control performed by high temperature coiling, precipitation of FeTiP, which causes hardening and decrease in ductility, is suppressed by controlling the contents of P, S, C and N so that annealing of hot-rolled steel sheets can be omitted.

As is the above method, in Japanese Unexamined Patent Application Publication No. 10-204588, a method for manufacturing stainless steel sheets having superior workability has been disclosed. In this method, the upper limits of P, C, S, and N contents forming phosphides, carbides, nitrides, and sulfides with Ti are controlled for suppressing the precipitation of phosphides, carbides, and sulfides in coiling of a hot-rolled steel sheet so as to facilitate recrystallization in the coiling mentioned above, and as a result, although annealing of a hot-rolled steel sheet is omitted, a stainless steel sheet having superior workability can be manufactured. In the above three conventional techniques, P and C precipitates, and P and C in a solid solution form are regarded as elements harmful to the workability, and it has been believed that it is important to reduce the contents of P and C as small as possible by refining.

The reduction of P and C contained in steel by refining described above is effective for improvement in steel properties; however, the reduction described above may cause some problems in some cases. For example, the following may be mentioned.

(1) When recycling of dust and slag by-produced in a steel-manufacturing process and reuse of scrap are taken into consideration, in order to reduce the contents of P and C in steel, which inevitably come from the starting materials mentioned above, to a predetermined level, refining for a long period of time is required in a steel-manufacturing process, and as a result, the productivity is decreased.

(2) By the reduction of the elements described above, it becomes difficult to control the growth of steel grains, and concomitant with larger and coarser grain diameters of a hot-rolled steel sheet, the anisotropy is increased, resulting in apparent generation of ridging (surface irregularities) and the like.

An object of the present invention is to provide stainless steel and a manufacturing method thereof, the stainless steel having improved workability and properties such as a yield strength. In the stainless steel described above, P present therein is allowed to remain to a certain extent by refining so that a load required for refining is decreased, and in addition, P in the form of larger and coarser Ti base precipitates is positively precipitated so as to make P harmless. In addition, an object of the present invention is to enable existing machines to be efficiently used without enhancing the capacities thereof and is to achieve recycling of steel materials and energy saving in manufacturing.

DISCLOSURE OF INVENTION

The aspects of the present invention are as follows.

That is, the present invention provides a Ti-containing ferritic stainless steel sheet comprising on mass percent basis: 0.01% or less of C; 0.5% or less of Si; 0.3% or less of Mn; 0.01% to 0.04% of P; 0.01% or less of S; 8% to 30% of Cr; 1.0% or less of Al; 0.05% to 0.5% of Ti; 0.04% or less of N; and the balance being substantially Fe and incidental impurities, in which $8 \leqq Ti/(C+N) \leqq 30$ is satisfied. In the Ti-containing ferritic stainless steel sheet, the grain size number of ferrite grain is 6.0 or more, and an average diameter Dp of precipitation diameters, each being [(a long axis length of a Ti base precipitate+a short axis length thereof)/2], of the precipitates in the steel sheet is in the range of from 0.05 μm to 1.0 μm. In addition, in the Ti-containing ferritic stainless steel sheet described above, at least 50% of the total Ti content in the steel sheet is precipitated in the form of the Ti base precipitates (phosphides, carbides). In addition, in the Ti-containing ferritic stainless steel sheet described above, at least 50% of the total P content in the steel sheet is precipitated in the form of the Ti base precipitates. In addition, the ferritic stainless steel sheet described above includes a hot-rolled steel sheet and a cold-rolled steel sheet.

In addition, the present invention provides a method for manufacturing a Ti-containing ferritic stainless steel sheet, which comprises the steps of: hot-rolling steel which contains on mass percent basis: 0.01% or less of C; 0.5% or less of Si; 0.3% or less of Mn; 0.01% to 0.04% of P; 0.01% or less of S; 8% to 30% of Cr; 1.0% or less of Al; 0.05% to 0.5% of Ti; 0.04% or less of N; and the balance being substantially Fe and incidental impurities, in which $8 \leqq Ti/(C+N) \leqq 30$ is satisfied, for forming a hot-rolled steel sheet, and performing recrystallization annealing of the hot-rolled steel sheet at a temperature in the range of (a precipitation nose temperature T of Ti base precipitates±50° C.) so that an average diameter Dp of precipitation diameters, each being [(a long axis length of a Ti base precipitate+a short axis length thereof)/2], of the Ti base precipitates in the steel sheet is in the range of from 0.05 μm to 1.0 m and so that a grain size number of ferrite grain is 6.0 or more. Alternatively, in addition, the method for manufacturing a Ti-containing ferritic stainless steel sheet, described above, may further comprise the steps of: cold-rolling the hot-rolled annealed steel sheet thus obtained; and subsequently performing final (recrystallization) annealing of the cold-rolled steel sheet at a temperature less than (a precipitation nose temperature T of Ti base precipitates+100° C.) and preferably at a temperature less than (the precipitation nose temperature T of Ti base precipitates+50) so that the average diameter Dp of precipitation diameters, each being [(a long axis length of a Ti base precipitate+a short axis length thereof)/2], of the Ti base precipitates is in the range of from 0.05 μm to 1.0 μm and so that the grain size number of ferrite grain is 6.0 or more and preferably 6.5 or more. In addition, in the method for manufacturing a Ti-containing ferritic stainless steel sheet, at least 50% of the total Ti content in each of the hot-rolled steel sheet and the cold-rolled steel sheet is precipitated in the form of the Ti base precipitates. In addition, in the method for manufacturing a Ti-containing ferritic stainless steel sheet, at least 50% of the total P content in each of the hot-rolled steel sheet and the cold-rolled steel sheet is precipitated in the form of the Ti base precipitate.

BEST MODE FOR CARRYING OUT THE INVENTION

In order to achieve the objects described above, the inventor of the present invention carried out detailed investigation of influences of precipitation behaviors of carbides and phosphides on the qualities of a cold-rolled annealed steel sheet by variously changing the P content of commercially available process materials. According to the results, instead of reducing the P content in steel as small as possible to suppress the precipitation of carbides and phosphides, in consideration of recycling of slag and dust, when the P content is allowed to remain in an appropriate amount as a starting material in a steel refining step so that the load required for refining is decrease, and when the size and amount of Ti base precipitates in a steel sheet and the grain size number of ferrite grain thereof are controlled in predetermined ranges, it was found that without reducing the P content as small as possible, the ductility and the r value of a hot-rolled and a cold-rolled sheet are improved.

Figure 4:
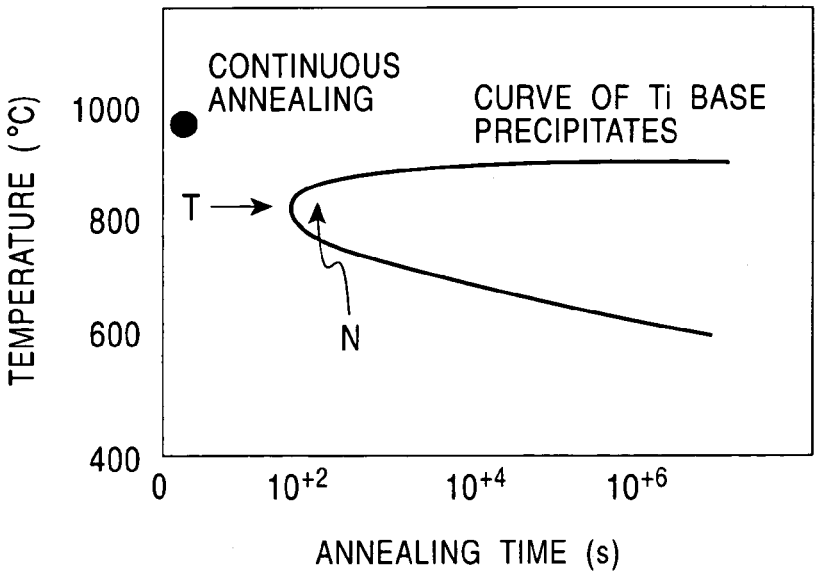
FIG. 4 is a TTP curve (schematic view) of Ti base precipitates (carbides, phosphides) of a hot-rolled annealed steel sheet.
Figure 5A:
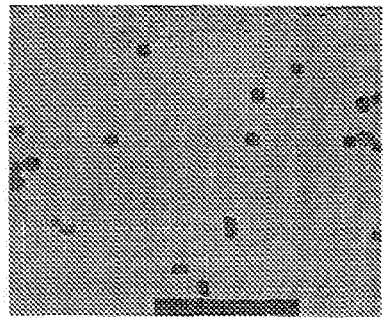
FIG. 5A shows the appearance (TEM/replica) of Ti base precipitates obtained by a conventional annealing condition for a hot-rolled steel sheet.
Figure 5B:
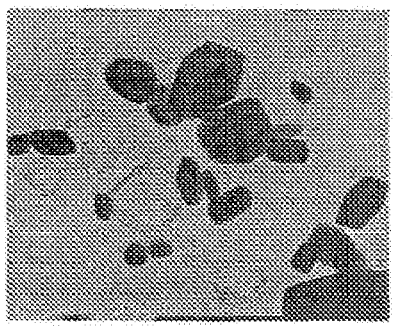
FIG. 5B shows the appearance (TEM/replica) of Ti base precipitates obtained by an annealing condition for a hot-rolled steel sheet of the present invention.
Figure 6A:
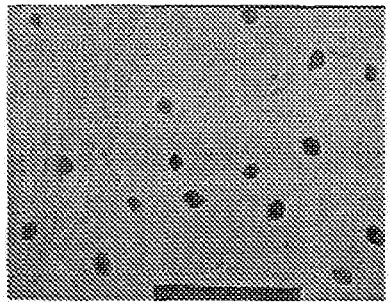
FIG. 6A shows the appearance (TEM/replica) of Ti base precipitates obtained by a conventional intermediate annealing condition (continuous annealing).
Figure 6B:
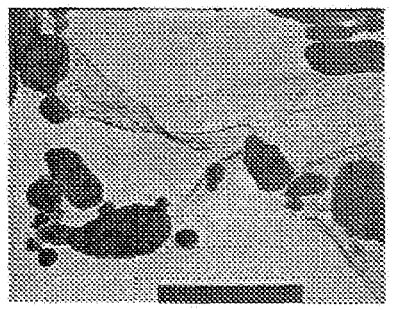
FIG. 6B shows the appearance (TEM/replica) of Ti base precipitates obtained by an intermediate annealing condition of the present invention.
Figure 7A:
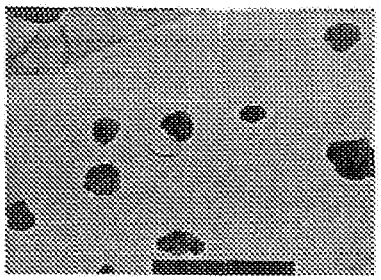
FIG. 7A shows the appearance (TEM/replica) of Ti base precipitates obtained by a conventional final annealing condition (continuous annealing).
Figure 7B:
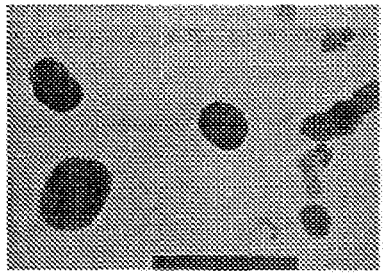
FIG. 7B shows the appearance (TEM/replica) of Ti base precipitates obtained by a final annealing condition of the present invention.

Specifically, in order to achieve the objects described above, by measuring the amounts of Ti precipitates at various annealing temperatures (500° C. to 1,000° C. at regular intervals of 25° C.) and for various annealing times (1 minute, 10 minutes, 1 hour, and 100 hours) using hot-rolled ferritic stainless steel sheets having various P contents (0.04% of C, 0.10% of Si, 0.25% of Mn, 0.013% to 0.046% of P, 0.003% of S, 16.2% of Cr, 0.02% of Al, 0.16% of Ti, and 0.008% of N), the inventor of the present invention obtained the range in which the amount of the Ti precipitates was at least 50% of the Ti content in the steel sheet, and subsequently, a TTP curve (curve showing the relationship among temperature, time, and precipitation/precipitation start curve) as shown in FIG. 4 was prepared. A temperature at a nose portion in FIG. 4 was represented by N and was defined as a precipitation nose temperature T (° C.) of Ti base precipitates (carbides, phosphides, and the like). In addition, after the hot-rolled steel sheets were annealed at various temperatures (500° C. to 1,000° C. at regular intervals of 25° C.) and for various annealing times (1 minute, 10 minutes, 1 hour, and 100 hours), from the change in hardness and the observation of the structures, recrystallization behaviors were investigated. From these measurement results, that is, by overlapping the TTP curve of Ti base precipitates and the relationship of the recrystallization behaviors, appropriate annealing conditions could be found for individual types of steel in which the precipitates were easily obtained and in which the recrystallization could be completed. In the TTP curve described above, the temperature and the logarithm of time were plotted in ordinate and in abscissa, respectively, and the contour line was drawn in which at least 50% of the total Ti content in the steel sheet was precipitated, thereby forming the precipitation curve.

In addition, the ratio of a part of the total Ti content in each of the hot-rolled annealed steel sheet and cold-rolled annealed steel sheet, which was precipitated in the form of the Ti base precipitates, was obtained by multiplying 100 and an analyzed amount (mass percent) of the Ti precipitates in steel divided by the total Ti content (mass percent) therein. "The total Ti amount (mass percent)" was measured in accordance with JIS G1258: 1999 (Iron and steel-Methods for inductively coupled plasma atomic emission spectrometry). That is, a sample is dissolved in an acid (hydrochloric acid+nitric acid). After a residue is recovered by filtration and is processed by an alkaline fusion (sodium carbonate+sodium borate), the residue thus processed is dissolved in hydrochloric acid and is mixed together with the acid solution mentioned above, and the mixture thus obtained is diluted with purified water to a predetermined volume. Subsequently, by an ICP emission spectrometer, the Ti amount (TiA) in this solution is quantified.

$$\text{Total Ti amount (mass percent)} = \text{TiA/sample weight} \times 100$$

"The precipitated Ti amount (mass percent)" is obtained by constant-current electrolysis (current density of 20 mA/cm$^2$ or less) of a sample using an acetyl acetone base electrolyte (a so-called AA solution). A residue in the electrolyte after this electrolysis is recovered by filtration and is processed by an alkaline fusion (sodium peroxide+lithium methaborate), and then the residue thus processed is dissolved by acid and is diluted with purified water to a predetermined volume. Subsequently, by an ICP emission spectrometer, the Ti amount (TiB) in this solution is quantified.

$$\text{Precipitated Ti amount (mass percent)} = \text{TiB/sample weight} \times 100$$

In addition, the form (size, distribution, and amount) of the Ti base precipitates of the hot-rolled annealed steel sheet were investigated by various changing precipitating temperatures T and times of recrystallization annealing. Furthermore, after this hot-rolled annealed steel sheet was cold-rolled, recrystallization annealing (final annealing) was performed at various temperatures, and the relationship among the size of the Ti base precipitates in the final cold-rolled steel sheet, the yield strength (hereinafter referred to as "YS"), and the grain size number was investigated.

According to the results, instead of reducing P in steel as small as possible by refining so as to suppress the precipitation of the Ti base precipitates, it was found that when the P content is allowed to remain in an appropriate amount in steel, and when at least 50% of Ti therein is subsequently precipitated in the form of large and coarse Ti precipitates as Ti precipitates having an appropriate size in a step in which the hot-rolled steel sheet is annealed, P and C dissolved in steel can be decreased so as to make P and C harmless and that at the same time a matrix can be purified. In addition, compared to a conventional low YS material having larger and coarser crystal grains due to high-temperature final annealing, it was found that a low YS material having a remarkably fine structure can be obtained.

That is, the observation results of Ti base precipitates of a hot-rolled annealed steel sheet, an intermediate-annealed steel sheet, and a final-annealed steel sheet obtained under conventional annealing conditions and the annealing conditions of the present invention are shown in FIGS. 5A, 5B, 6A, 6B, 7A, and 7B. In the annealed materials under the conventional annealing conditions, the size of the Ti base precipitates finely precipitated in the hot-rolled annealed steel sheet is gradually increased in subsequent annealing of a cold-rolled steel sheet (intermediate annealing and final annealing) (see FIGS. 6A and 7A); however, on the other hand, unlike the case described above, in the annealed materials containing the Ti base precipitates according to the present invention, large and coarse precipitates are gradually dissolved (see FIGS. 6B and 7B). In addition, in the hot-rolled annealed steel sheet obtained under the conventional annealing conditions, elements such as P and C in a solid solution form remain in the matrix, and furthermore, since the Ti base precipitates are fine, the tensile strength (hereinafter referred to as "TS") is high, and the ductility is poor. Fine precipitation of the Ti base precipitates insufficiently performed by subsequent heat treatment hardens steel.

According to the present invention, (1) Ti base precipitates (carbides, phosphides) in a hot-rolled steel sheet are precipitated in a large and coarse form at a low density by precipitate annealing; (2) elements such as P and C in a solid solution form are decreased thereby, and concomitant with the improvement in purity of a matrix and with the formation of the larger and coarser Ti base precipitates at a lower density, a recrystallization temperature of a cold-rolled intermediate-annealed steel sheet is decreased; and (3) by annealing of the cold-rolled sheet at a low temperature, redissolution of the Ti base precipitates (phosphides, carbides) in the hot-rolled steel sheet is suppressed (a recrystallization temperature of a final-annealed sheet is also decreased by the same mechanism as described above). Accordingly, as the C and P in a solid solution form are decreased, since the precipitates grow large and coarse and have a low density as compared to the conventional annealed material, (4) in the cold-rolled annealed steel sheet, a low YS, a low TS, a high elongation (hereinafter referred to as "ductility El"), and a high r value can be achieved.

Hereinafter, individual important points of the present invention will be described. First, the contents of individual elements of the Ti-containing ferritic stainless steel sheet will be described. In the present invention, the content of each component is represented by mass percent and may be simply represented by % in some cases.

(1) C: 0.01% or Less:

When C is contained in a solid solution form, steel is hardened (solid solution reinforcement). In addition, C precipitates in the form of Cr base carbides and is primarily located in grain boundaries, resulting in degrading secondary cold-work embrittlement and corrosion resistance of the grain boundaries. In particular, when the content is more than 0.01%, the influence becomes significant, and hence the content is limited to 0.01% or less. In addition, in consideration of the load required for refining and control of precipitates, the content is preferably in the range of from more than 0.002% to 0.008%.

(2) Si: 0.5% or Less:

Si is an effective element for improving oxidation resistance and corrosion resistance and improves the corrosion resistance in the atmospheric environment. In addition, Si is used as a deoxidizing agent for removing oxygen in steel. However, when the Si content is increased, concomitant with the increase of Si in a solid solution form, steel is hardened (solid solution reinforcement), and the ductility is also decreased. Accordingly, the upper limit of the content is set to 0.5%. The content is preferably in the range of from 0.05% to 0.2%.

(3) Mn: 0.3% or Less:

Mn is an effective element for improving oxidation resistance; however, when it is excessively contained, the toughness of steel is degraded, and resistance against secondary cold-work embrittlement of a welded portion is also degraded. Accordingly, the content is set to 0.3% or less. The content is preferably in the range of from 0.15% to 0.25%.

(4) P: 0.01% to 0.04%:

P is concentrated in grain boundaries and makes steel brittle. In addition, when being dissolved in a solid solution form, P remarkably hardens steel and degrades the ductility thereof. Furthermore, the P content is preferably low in view of resistance against cold-work embrittlement of a welded portion and of high-temperature fatigue properties. However, when recycling of various starting materials used in a steel-manufacturing process is considered, excessive reduction in P content may result in increase in steel-manufacturing cost. In addition, when the P content is decreased, the size of the Ti base precipitates is decreased. In addition, by strain caused by hot rolling, the stability of the precipitates is decreased. In addition, when the volumes of the precipitates are equivalent to each other, a small precipitate having a high density has a higher capability of hardening steel than a large precipitate having a low density; hence, the control of precipitates is important so as to have a large and coarse form having a low density. Accordingly, in order to form P into relatively large and coarse precipitates present in a hot-rolled annealed steel sheet, it is important to allow an appropriate amount of P to remain.

In addition, when the P content is more than 0.04%, since corrosion resistance and toughness are seriously degraded, the upper limit is set to 0.04%. In addition, in view of the load required for refining steel, recycling of refined dust, slag, and scrap in a steel-manufacturing process, and the control of precipitates, a content of from 0.01% to 0.04% is set as an appropriate range. In consideration of the load required for refining and recycling described above, the P content is preferably in the range of from 0.020% to 0.030%.

(5) S: 0.01% or Less:

S degrades the corrosion resistance of steel. However, since S can stabilize C in a solid solution form in steel at a high temperature as a stable precipitate in the form of $Ti_4C_2S_2$, even when S is contained to a certain extent, serious problems may not occur. Accordingly, in consideration of an economical load for desulfurization in steel manufacturing, the content is set to 0.01% or less. The content is preferably in the range of from 0.002% to 0.006%.

(6) Cr: 8% to 30%:

Cr is an effective element for improving corrosion resistance. However, in order to ensure sufficient corrosion resistance, the content must be 8% or more. In addition, in order to ensure higher-level corrosion resistance such as that required in a seaside environment or at a welded portion, a content of 11% or more is preferable at which a passivation film becomes stable. On the other hand, Cr is an element degrading the workability of steel, and in particular, at a content of more than 30%, the influence becomes apparent. Furthermore, due to an effect combined with another element, steel becomes brittle by precipitation of a $\sigma$ phase or a $\chi$ phase, and hence the upper limit is set to 30%. The content is preferably in the range of from 15% to 20%.

(7) Al: 1.0% or Less:

Al is an essential element as a deoxidizing agent in steel; however, in order to obtain the above effect, 0.005% or more of Al must be added. An excessive addition of Al may cause the formation of oxide base inclusions. As a result, the surface appearance and the corrosion resistance are deteriorated, and hence the content is set to 1.0% or less. The content is preferably set in the range of from 0.01% to 0.2%.

(8) Ti: 0.05% to 0.5%, and $8 \leqq Ti/(C+N) \leqq 30$ [In the Inequality, Ti, C, and N Represent Individual Elements Contained in Steel (Mass Percent)]:

Ti stabilizes C and N in a solid solution form as carbonitrides and P and S as a Ti base phosphide and Ti base sulfides such as FeTiP, $Ti_4C_2S_2$, and TiS. Since the content of Ti has significant influences on the size and precipitation behavior of the Ti base precipitates as described above, Ti is a very important element for controlling the material quality in the present invention.

Since forming the precipitates as described above with various elements dissolved in steel, Ti has effects of improving the corrosion resistance and workability. However, when the content is less than 0.05%, C, N, P, and S cannot be formed into large and coarse Ti base precipitates and cannot be made harmless, the content must be 0.05% or more. On the other hand, when the content is more than 0.5%, since the amount of Ti in a solid solution form is increased, hardening of steel, decrease in ductility, and decrease in toughness occur, and hence the upper limit is set to 0.5%. The content is preferably in the range of from 0.10 to 0.25%. In addition, since Ti forms stable carbides and nitrides with C and N, respectively, $8 \leqq Ti/(C+N) \leqq 30$ must be satisfied at the same time. In addition, $10 \leqq Ti/(C+N) \leqq 15$ is preferably satisfied.

(9) N: 0.04% or Less:

When the content of N is appropriate, grain boundaries are enhanced, and hence the toughness is improved. However, when the content is more than 0.04%, N precipitates in a nitride form in the grain boundaries, and the corrosion resistance is very adversely affected. In addition, since N forms TiN with Ti, which causes scratches on a cold-rolled sheet, in particular, on a gloss product, the upper limit is set to 0.04%. As described above, the amount of N is preferably decreased; however, in the case of ferrite single phase steel, ridging is effectively improved since the growth of columnar crystals in a slab is suppressed by TiN, and hence the content is preferably in the range of from 0.005% to 0.02% when the load required for refining is also taken into consideration.

(10) Other Components:

The composition of stainless steel manufactured according to the present invention basically contains the components described above. The following steel containing components besides the components described above may also be manufactured in accordance with the present invention; for example, there may be mentioned steel containing Fe and inevitable impurities and steel containing optional components at contents in the ranges which are not outside the scope of the present invention. For example, in view of improvement in grain boundary brittleness, at least one of 0.3% or less of Ni, Cu, and Co, and 0.01% or less of B may be contained.

In addition, at least one of 0.5% or less of Nb, 0.5% or less of Zr, 0.1% or less of Ca, 0.3% or less of Ta, 0.3% or less of W, 0.3% or less of V, 0.3% or less of Sn, and 2.0% or less of Mo may be contained in view of improvement in corrosion resistance, productivity (toughness improvement), weldability, workability, and the like. In addition, as for Mg, it is dissociated from slag or a refractory forming a container for use in a steel-manufacturing process and is contained at a content of 0.003% or less; however, the content thereof may not cause any serious problem.

(11) Average Diameter Dp of Ti Base Precipitates and Grain Size of Number Ferrite Grain:

Besides the steel component compositions described above, the present invention defines the average diameter Dp of grain diameters, each being [(along axis length of a Ti base precipitate+a short axis length thereof)/2], of the Ti base precipitates in steel and the grain size number of ferrite grain in a specific range. The reasons the average diameter Dp and the grain size number of ferrite grain are focused are as follows.

In the present invention, since the P content in steel which is increased as recycling of steel sheets is repeated is controlled in the range of from 0.01% to 0.04% (preferably 0.02% or more) by refining having a load equivalent to that in the past, and the sizes of precipitated Ti base carbides and Ti base phosphides are formed larger and coarser than a predetermined size, harmless conditions can be formed. In addition, by using a pinning effect of the Ti base precipitates described above, the formation of large and coarse grains of the steel sheet is controlled, and besides the ductility and ridging, the anisotropy of mechanical properties can also be improved. In this case, since the precipitates such as the Ti base carbides and the Ti base phosphides have not a uniform shape, when the size is evaluated, the average diameter Dp of the Ti base precipitates in a steel sheet is used.

In the present invention, the average diameter Dp is defined as the average values calculated from the results of 100 precipitates which are obtained by the steps of performing electrolysis of a cross-section of a test piece in a rolling direction using a 10% AA solution (10% of acetyl acetone, 1% of tetramethylammonium chloride, and methanol), sampling an extracted replica, observing 100 Ti base precipitates in a viewing field by a transmission electron microscope (an acceleration voltage of 200 kV) at a magnification of 20,000 to 200,000, and obtaining (a long axis length of each Ti base precipitate+a short axis length thereof)/2 from each precipitate. When the Ti base precipitates each have an ideally spherical form, since the long axis length is equal to the short axis length, the diameter of the precipitate may be used as the average diameter Dp; however, in practice, the spherical form is not present in many cases. Accordingly, as an index of the size of the Ti base precipitates, the largest length in the longitudinal direction is regarded as the long axis, the length in the direction perpendicularly intersecting the center of this long axis is regarded as the short axis, and the data of (a long axis length of the Ti base precipitate+a short axis length thereof)/2 obtained from 100 precipitates is averaged and is defined as the average diameter Dp (μm).

In addition, the precipitation temperatures and speeds of Ti base phosphides, Ti base carbides, and other Ti base precipitates vary in accordance with the contents of elements forming the Ti base precipitates; however, when the content is increased, the precipitation tends to occur at a higher temperature and for a shorter period of time. Accordingly, box annealing is effectively carried out in which in accordance with a component, recrystallization of a matrix and precipitation of Ti base precipitates are optionally performed at a temperature close to the precipitation nose temperature.

(12) Average Diameter Dp [(Long Axis Length of Ti Base Precipitate+Short Axis Length Thereof)/2] of Ti Base Precipitates of Hot-Rolled Annealed Steel Sheet and Cold-Rolled Annealed Steel Sheet: 0.05 μm to 1.0 μm:

In general, Ti base precipitates in a steel sheet have been known as materials degrading the workability thereof. However, in the hot-rolled annealed steel sheet and cold-rolled sheet of the present invention, when the Ti base precipitates are grown in a large and coarse form to have an average diameter Dp of 0.05 μm to 1.0 μm, inversely, the Ti base precipitates are made harmless. Furthermore, the matrix is purified, and superior workability of the steel sheet can be obtained. In addition, when a hot-rolled annealed steel sheet having an average diameter Dp of 0.05 μm to 1.0 μm is further processed by cold rolling, since the amounts of C and P dissolved in the hot-rolled steel sheet are decreased in addition to the decrease in recrystallization temperature, {111} textures parallel to a sheet surface, which advantageously improve the r value, are significantly grown. Accordingly, the average diameter Dp of the Ti base precipitates is one of the most important points of the present invention.

In addition, since the recrystallization temperature is decreased, the intermediate annealing temperature or the final annealing temperature is also decreased. As a result, since the amounts of C and P dissolved in the final cold-rolled steel sheet are decreased, softening, high ductility, and a low YS of steel can be achieved. However, when Ti base precipitates are very fine having an average diameter Dp of less than 0.05 μm, since the thermal stability of the Ti base precipitates is degraded due to strain caused by cold rolling, the Ti base precipitates are redissolved in annealing of a cold-rolled steel sheet, and as a result, in addition to the increase of P and C in a solid solution form, the steel is hardened by a precipitation effect caused by the fine Ti base precipitates. Furthermore, the growth of the {111} textures is suppressed by the fine precipitates, and as a result, the material quality is degraded. Accordingly, the lower limit of the average diameter Dp of the Ti base precipitates is set to 0.05 m. The Ti base precipitates having a larger size within the range described above are effective; however, when the average diameter Dp is more than 1.0 μm, although the ductility is effectively improved, the r value is rapidly decreased. The reason for this has been believed that since abnormal structure are formed around the large and coarse precipitates in cold rolling, {110} recrystallization texture is liable to be formed which is harmful to the r value. According to the reason described above, the average diameter Dp of the Ti base precipitates in hot-rolled annealed and cold-rolled annealed steel sheets is set in the range of from 0.05 μm to 1.0 μm, preferably from 0.2 μm to 0.6 μm, and more preferably from 0.3 μm to 0.5 μm.

(13) Grain Size Number of Ferrite Grain of Hot-Rolled Annealed Steel Sheet and Cold-Rolled Annealed Steel Sheet: 6.0 or More:

The grain size number of a hot-rolled annealed steel sheet influences the ridging and the r value of a cold-rolled annealed steel sheet. Since the number of grain boundaries functioning as nucleus-generating sites for recrystallization is increased as the crystal grain size is smaller, the degree of integration of the {111} texture in a final annealed steel sheet is increased, and hence it is advantageous for the r value. As described above, a good correlation is present between the crystal grain size of the hot-rolled steel sheet and the r value of the cold-rolled steel sheet, and the r value is improved as the crystal grains of the hot-rolled annealed steel sheet become larger and coarser; however, when the grain size number is more than 6.0, the ridging and the anisotropy of mechanical properties are increased, and when the grain sizes become further larger and coarser, the r value is decreased. By the reasons described above, the lower limit of the grain size number of ferrite grain of the hot-rolled annealed steel sheet is set to 6.0. In the case of an intermediate-annealed steel sheet which is processed by three times annealing including intermediate annealing and two-time cold rolling, since the recrystallization temperature of the intermediate-annealed steel sheet is decreased as compared to that of a hot-rolled steel sheet, the grain size number is preferably set to 6.5 or more. In the present invention, the grain size number is measured by a section method in accordance with JIS G0552 (Methods of grain size number of ferrite grain determination test for steel) in which five viewing fields on a cross-section surface in the rolling direction (L direction) are observed at a magnification of 100, and the grain sizes number thus measured are then averaged to obtain the average value.

Even when a steel sheet is manufactured through cold rolling and final annealing, the grain size number of ferrite grain of a final-annealed steel sheet must be 6.0 or more. The ferrite crystal grain size of the final-annealed steel sheet (ferrite grain size after final annealing) influences the surface roughness thereof after forming processing. When the grain size is increased, the ductility and the r value can be improved; however, when the grain size number is less than 6.0, as the grain diameter becomes larger and coarser, a rough surface, a so-called orange peel, is formed on a product surface after processing, and as a result, in addition to deterioration of the appearance, the corrosion resistant and the formability are degraded resulting from the rough surface. Hence, the grain size number of the final-annealed steel sheet must be 6.0 or more and preferably 6.5 or more.

(14) Precipitation Ratio of Ti and P in Hot-Rolled Annealed Steel Sheet and Cold-Rolled Annealed Steel Sheet:

When at least 50% of the total Ti content in a hot-rolled annealed steel sheet and a cold-rolled annealed steel sheet is precipitated in the form of the Ti base precipitates, almost all the P and C in steel can be precipitated in the form of the Ti base precipitates. Accordingly, large amounts of the P and C dissolved in steel can be decreased. When less than 50% of the total Ti content is precipitated in the form of the Ti base precipitates, in addition to insufficient reduction of the P and C dissolved in steel, fine precipitates are increasingly precipitated, and as a result, the effect of improving workability cannot be obtained.

More preferably, it is desirable that at least 70% of the total Ti content in the hot-rolled annealed steel sheet and the cold-rolled annealed steel sheet be precipitated. Even more preferably, it is desirable that in addition to the precipitated amount of Ti described above, the amount of P base precipitates be at least 50% of the total P content.

The ratio of a part of the total Ti content in each of the hot-rolled annealed steel sheet and the cold-rolled annealed steel sheet, which was precipitated in the form of the Ti base precipitates, was obtained by multiplying 100 and an analyzed amount (mass percent) of the precipitated Ti in steel divided by the total Ti content (mass percent) therein. "The total Ti amount (mass percent)" was measured in accordance with JIS G1258:1999 (Iron and steel—Methods for inductively coupled plasma atomic emission spectrometry). That is, a sample is dissolved in an acid (hydrochloric acid+nitric acid). After a residue is recovered by filtration and is processed by an alkaline fusion (sodium carbonate+sodium borate), the residue thus processed is dissolved in hydrochloric acid and is mixed together with the acid solution mentioned above, and the mixture thus obtained is diluted with purified water to a predetermined volume. Subsequently, by an ICP emission spectrometer, the Ti amount (TiA) in this solution is quantified.

Total Ti amount (mass percent)=TiA/sample weight×100

"The precipitated Ti amount (mass percent)" is obtained by constant-current electrolysis (current density of 20 mA/cm$^2$ or less) of a sample using an acetyl acetone base electrolyte (a so-called AA solution). A residue in the electrolyte after this electrolysis is recovered by filtration and is processed by an alkaline fusion (sodium peroxide+lithium methaborate), and then the residue thus processed is dissolved by acid and is diluted with purified water to a predetermined volume. Subsequently, by an ICP emission spectrometer, the Ti amount (TiB) in this solution is quantified.

Precipitated Ti amount (mass percent)=TiB/sample weight×100

In addition, the ratio of a part of the total P content in each of the hot-rolled annealed steel sheet and the cold-rolled annealed steel sheet, which was precipitated in the form of the Ti base precipitates, was obtained by multiplying 100 and an analyzed amount (mass percent) of the precipitated P in steel divided by the total P content (mass percent) therein. "The total P amount (mass percent)" was measured in accordance with JIS G1214:1998 (Iron and steel_|Methods for determination of phosphorus content) That is, a sample is dissolved in an acid (nitric acid+hydrochloric acid+perchloric acid) and white fume treatment is performed using perchloric acid so as to form orthophosphoric acid from phosphorus, followed by the formation of a complex with molybdic acid. Subsequently, by molybdophosphoric acid-blue complex (molybdenum blue) absorption spectroscopy, the P amount (PA) in this solution is quantified.

Total P amount (mass percent)=PA/sample weight×100

On the other hand, "the precipitated P amount (mass percent)" is obtained by constant-current electrolysis (current density of 20 mA/cm$^2$ or less) of a sample using an acetyl acetone base electrolyte (a so-called AA solution). A residue in the electrolyte after this electrolysis is recovered by filtration and is dissolved by acid (nitric acid+hydrochloric acid+perchloric acid), and phosphorus is then processed by white fume treatment using perchloric acid to form orthophosphoric acid from phosphorus, followed by the formation of a complex with molybdic acid. Subsequently, by molybdophosphoric acid blue (molybdenum blue) absorption spectroscopy, the P amount (PB) in this solution is quantified.

Precipitated P amount (mass percent)=PB/sample weight×100

(15) Method for Manufacturing Ti-Containing Ferritic Stainless Steel Sheet Having Low Yield Strength Next, a preferable method for manufacturing the Ti-containing ferritic stainless steel sheet having a low yield strength according to the present invention will be described.

A process for manufacturing the stainless steel sheet of the present invention includes a steel-manufacturing step, a step of manufacturing a slab from molten steel by continuous casting or the like, a step of heating the slab, a hot rolling step, and a step of annealing a hot-rolled steel sheet. Alternatively, in addition to the steps described above, a cold-rolled steel sheet is manufactured by a series of steps including a cold rolling step and a final annealing step. In the present invention, the conditions of the annealing step of the hot-rolled steel sheet after hot rolling and of the final annealing step after cold rolling are defined.

According to the present invention, after hot rolling, recrystallization annealing is first performed so that the average diameter Dp of the Ti base precipitates is in a specific range. Specifically, the Ti base precipitates indicate a phosphide (FeTiP), carbides (TiC, TiS, and $Ti_4C_2S_2$), and the like. In many cases, the precipitates are mostly composed of FeTiP and TiC having a precipitation nose temperature T of approximately 650° C. to 850° C.

(16) Annealing of Hot-Rolled Steel Sheet:

In the present invention, it is important that the Ti base precipitates in the hot-rolled steel sheet be grown large and coarse to have a predetermined size. As the methods therefor, for example, control of hot rolling and a coiling temperature, or box annealing (box furnace) performed longer than continuous annealing may be applied. Regardless of the methods, it is important that C and P dissolved in the hot-rolled steel sheet be precipitated in the form of large and coarse Ti base precipitates having an average diameter Dp of 0.05 μm to 1.0 μm so as to be made harmless. Accordingly, the workability of steel is improved. Since the optimum temperature is in the vicinity of the precipitation nose temperatures of FeTiP and TiC, it is naturally understood that Ti, P, C, S, and N in the steel and the coiling condition for a hot-rolled sheet have influences on the optimum temperature. However, the annealing temperature and a soaking temperature are preferably in the range of from 650° C. to 850° C. in which the precipitation is most effectively promoted. A holding time of box annealing, the hot rolling conditions, and a holding time or a cooling rate in a coiling or a cooling step are set so that the average diameter Dp of the Ti base precipitates is controlled in the range described above. Furthermore, at least 50% of the total Ti content in the steel is precipitated in the form of the Ti base precipitates. A preferable holding time is 1 to 100 hours in consideration of practical operation and is more preferably in the range of from 1 to 10 hours.

In manufacturing of the stainless steel sheet of the present invention, the form of the precipitates in the hot-rolled annealed steel sheet determines the properties of the steel, and when the Ti base precipitates are grown larger and coarser than a predetermined size, a matrix of the hot-rolled annealed steel sheet can be purified, and the recrystallization temperature after cold rolling is decreased. In addition, since the amounts of C and P dissolved in the hot-rolled annealed steel sheet are decreased, and the growth of the {111} textures, which effectively improve the r value, is significantly promoted, and the r value in the final cold-rolled steel sheet is also improved. By the decrease in annealing temperature of a cold-rolled steel sheet, which will be described later, redissolution of C and P precipitated in the form of the Ti base precipitates is suppressed, and as a result, a low yield strength, softening, and high ductility of the final cold-rolled steel sheet can be achieved.

The annealing temperature for the hot-rolled steel sheet must be controlled in the range of (a precipitation nose temperature of Ti base precipitates±50° C.). Otherwise, the Ti base precipitates having a predetermined average diameter Dp cannot be precipitated. In addition, at least 50% of Ti in the steel sheet cannot be precipitated in the form of the Ti base precipitates. Accordingly, the TTP curve was formed from the precipitation behavior of Ti, and as a result, the precipitation nose temperature T was found. Particular methods for forming the TPP curve and for obtaining the precipitation nose temperature T are the same as those described with reference to FIG. 4. That is, for each steel having the corresponding composition, precipitated Ti amounts were measured at various annealing temperatures (500° C. to 1,000° C. at regular intervals of 25° C.) and for various annealing times (1 minute, 10 minutes, 1 hour, and 100 hours), and a precipitation curve was obtained in which the precipitated Ti amount was at least 50% of the total Ti amount in a steel sheet. Subsequently, the temperature corresponding to the nose portion N shown in FIG. 4 was regarded as the precipitation nose temperature T (° C.) of the Ti base precipitates (carbides, phosphides, and the like).

Since an object of annealing of the hot-rolled steel sheet includes recrystallization of ferrite structures thereof, the annealing temperature and the annealing time are set to (a precipitation nose temperature of Ti±50° C.) so that Ti base precipitates having a predetermined size and a predetermined precipitated amount of (at least 50% of the total Ti amount in steel) is obtained in a short period of time. When the annealing temperature is too high, although the recrystallization occurs, the size of the Ti base precipitates is small and the amount thereof is small, and as a result, large amounts of C and P in a solid solution form are allowed to remain in the matrix. In addition, when the annealing temperature is low, the recrystallization is unlikely to occur, and a small amount of the Ti base precipitates is only precipitated. In determining the annealing temperature, it is effective to estimate the precipitation nose of the Ti base precipitates from the precipitated amount thereof with reference to results obtained from investigation performed beforehand.

(17) Final Annealing:

Recrystallization annealing (final annealing) is performed for the cold-rolled steel sheet at a temperature less than (a precipitation nose temperature T of Ti base precipitates+100° C.) so that the grain size number of ferrite grain is 6.0 or more.

As the final annealing is performed at a higher temperature, {111} orientation grains are selectively grown, and a high r value can be obtained. When the final annealing temperature is low, and non-recrystallized structures remain, the workability is degraded. In order to increase the r value, final annealing performed at a high temperature is effective; however, on the other hand, the crystal grain size is increased, and a rough surface is formed after forming, thereby causing decrease in formability limit and degradation of corrosion resistance. Accordingly, the final annealing temperature is preferably increased as long as a grain size number of 6.0 or more and preferably of 6.5 or more can be ensured. In addition, in particular, the present invention is characterized in that P and C are precipitated in the form of large and coarse phosphides such as FeTiP and carbides such as TiC, respectively, so as to be harmless. However, the Ti base precipitates mentioned above tend to be dissolved at a temperature of 850° C. or more. For example, even in continuous annealing in which heating is rapidly performed and is held for a short period of time, when heat treatment is performed at a temperature of more than 900° C., dissolution of the precipitates proceeds, and hence the upper limit of a preferable temperature is set to 900° C. In addition, although the lower limit of the final annealing temperature is the recrystallization temperature, a preferable temperature is set so that the grain size number is in the range of from 6.0 to 7.5. Furthermore, more preferably, the temperature is set so that the grain size number is in the range of from 6.5 to 7.0.

The grain size number of the cold-rolled annealed steel sheet influences the ridging, r value, YS, and workability. By annealing at a high temperature, the crystal grain size is increased, and by a grain-diameter effect, the YS is decreased (Holl-pitch rule), and the ductility is improved. However, when the crystal grain number is less than 6.0, rough surfaces are apparently formed, and in addition to increase in anisotropy of the mechanical properties, the appearance is deteriorated. In addition, due to the rough surfaces, the corrosion resistance and the workability are degraded. In addition, when the annealing temperature for the cold-rolled steel sheet is higher than the precipitation nose temperature T of Ti by more than 100° C., the Ti base precipitates are redissolved, and the YS is increased.

In the case of a hot-rolled annealed steel sheet in which the Ti base precipitates are grown larger and coarser than a certain size, the larger and coarser precipitates remain after final annealing is performed, and a cold-rolled annealed steel sheet can be obtained which is made of fine grains and which has a low yield strength.

Steel slabs having the compositions shown in Table 1 were heated and then hot-rolled, thereby forming hot-rolled steel sheets having a thickness of 4 mm. For each of the hot-rolled steel sheets, precipitated Ti amounts were measured at various annealing temperatures (500° C. to 1,000° C. at regular intervals of 25° C.) and for various annealing times (1 minute, 10 minutes, 1 our, and 100 hours), and the range in which the precipitated Ti amount was at least 50% of the total Ti content in the steel sheet was obtained, thereby forming a TTP curve (precipitation start curve) of the Ti base precipitates as shown in FIG. 4. Subsequently, the precipitation nose temperature T (770° C.) was determined. Next, recrystallization annealing was performed for the hot-rolled steel sheet at 800° C. (the precipitation nose temperature T±50° C.) so as to change the size of the Ti base precipitates, and hot-rolled annealed steel sheets having average grain diameters Dp of 0.03 μm and 0.28 μm were obtained. Subsequently, after a cold-rolled steel sheet having a thickness of 0.8 mm was formed by cold rolling at a total reduction in thickness of 80%, annealing of the cold-rolled steel sheet was performed for various periods of time, thereby forming cold-rolled annealed steel sheets having various grain sizes. Next, the crystal grain size of the hot-rolled annealed steel sheet and the yield strength of the cold-rolled annealed steel sheet were compared to each other. The results are shown in Table 2.

In the present invention, the yield strength is measured in accordance with JIS Z2241.

Figure 3:
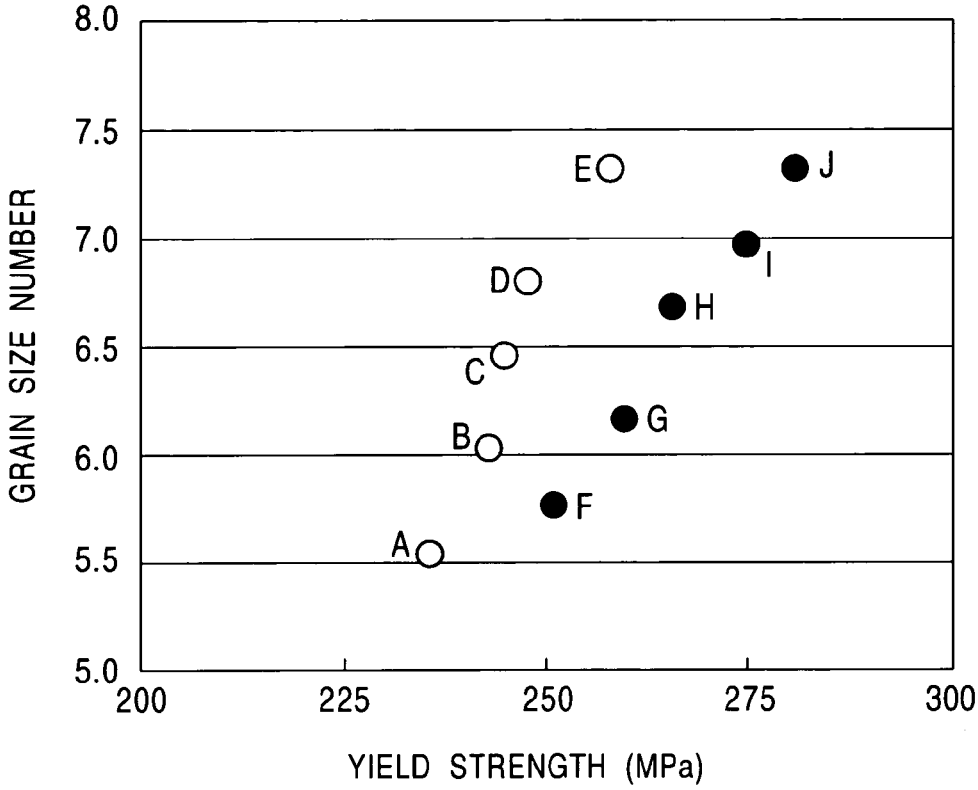
FIG. 3 is a graph showing the relationship between a grain size number (Gs. No.) of a hot-rolled annealed steel sheet and the yield strength (MPa) of a cold-rolled annealed steel sheet.

The average diameter Dp of the Ti base precipitates in the hot-rolled steel sheet of each of sample Nos. A to E is set to 0.28 μm, and the average diameter Dp of the Ti base precipitates in the hot-rolled steel sheet of each of sample Nos. F to J is set to 0.03 μm. The relationship between the grain size number of ferrite crystal grains of the hot-rolled annealed steel sheet and the yield strength of the cold-rolled annealed steel sheet is shown in FIG. 3. From Table 2 or FIG. 3, it was found that even among steel materials having the same component system, between cold-rolled steel sheets having the same grains size, a lower yield strength can be obtained from one of the cold-rolled steel sheets which is made from a hot-rolled annealed steel sheet having a larger average diameter Dp of the Ti base precipitates.

In addition, it was also found that when the average diameter Dp of the Ti base precipitates of the hot-rolled annealed steel sheet is set in the range of from 0.05 μm to 1.0 μm, a preferably low yield strength is obtained. In addition, it was also found that when a cold-rolled annealed steel sheet is processed by deep drawing which has a grain size number of 6.0 or more and preferably 6.5 or more and which is obtained by annealing at a precipitation nose temperature T of Ti base precipitates+100° C. or less, rough surfaces are not formed, and that, in addition, the Ti base precipitates in the cold-rolled steel sheet are not dissolved. As the lower limit of the final annealing temperature, a temperature is preferably set so that the grain size described above is satisfied and that non-recrystallized grains are not allowed to remain. In addition, in order to precipitate Ti base carbides and Ti base phosphides so that the shapes thereof are as large and coarse as possible, the annealing temperature of the cold-rolled steel sheet is preferably set to a precipitation nose temperature T of Ti base precipitates+50° C. or less.

The grain diameters described in the present invention are all measured by a section method in accordance with JIS G0552 in which five viewing fields on a cross-section surface in the rolling direction (L direction) are observed at a magnification of 100, and the grain sizes thus measured are then averaged to obtain the average value.

In the present invention, as for steps other than the annealing step for the hot-rolled steel sheet after hot rolling and the annealing step for the cold-rolled steel sheet after cold rolling, the conditions thereof are not specifically limited; however, in the individual steps, the following conditions are preferable.

(18) Slab Heating:

When a slab heating temperature is too low, rough surfaces are formed, and in addition, it becomes difficult to perform hot rolling under predetermined conditions by rough rolling. On the other hand, when the slab heating temperature is too high, the structure of a hot-rolled steel sheet becomes large and coarse, and structures become non-uniform in the thickness direction. In addition, $Ti_4C_2S_2$ is redissolved, and C and S are dissolved in the steel in a solid solution form. Accordingly, the slab heating temperature is set in the range of from 950° C. to 1,150° C. The preferable temperature range is in the range of from 1,000° C. to 1,100° C.

(19) Hot Rough Rolling:

At least one pass of hot rough rolling (hereinafter simply referred to as rough rolling) is performed at a rolling temperature of 850° C. to 1,100° C. and at a reduction in thickness of 40% or more per pass. When the rolling temperature of rough rolling is less than 850° C., recrystallization is unlikely to occur, the workability of a final-annealed steel sheet is inferior, and in-plane anisotropy is increased. In addition to those described above, a load applied onto rolling rolls is increased, and as a result, the serviceable life thereof is decreased. On the other hand, when the temperature is more than 1,100° C., a structure is formed in which the ferrite grains extend in the rolling direction, and as a result, the anisotropy is increased. Hence, the rolling temperature in rough rolling is set in the range of from 850° C. to 1,100° C. The preferable temperature range is in the range of from 850° C. to 1,000° C.

In addition, when the reduction in thickness in rough rolling is less than 40% per pass, since a large amount of a non-crystallized part in a band shape remains at a central portion in the thickness direction, ridging is generated in the cold-rolled steel sheet, and hence the workability thereof is degraded. However, when the reduction in thickness in rough rolling is more than 60% per pass, seizing may occur in rolling and biting defects may also occur in some cases. Accordingly, in particular, the reduction in thickness is preferably in the range of from 40% to 60% per pass. In addition, in a steel material having a low high-temperature strength, an intensive shear strain may be generated on surfaces of the steel sheet in rough rolling so that a non-recrystallized structure remains at the central portion in the thickness direction, and in addition, seizing may also occur in rough rolling. In the case described above, whenever necessary, lubrication treatment may be performed so as to have a friction coefficient of 0.3 or less. When rough rolling is performed at least one pass under the conditions in which the rolling temperature and the reduction in thickness described above are satisfied, deep drawing properties can be improved. This one pass may be performed at any stage in rough rolling; however, in consideration of a rolling machine capacity, this pass is most preferably performed as the last pass.

(20) Hot Final Rolling:

At least one pass of hot final rolling (hereinafter simply referred to as final rolling) following the rough rolling is preferably performed at a rolling temperature of 650° C. to 900° C. and at a reduction in thickness of 20% to 40% per pass. When the rolling temperature is less than 650° C., deformation resistance is increased, a reduction in thickness of 20% or more per pass is difficult to reliably obtain, and in addition, the load applied onto rolls is increased. On the other hand, when the final rolling temperature is more than 900° C., the accumulation of rolling strain is decreased, and an effect of improving the workability in a subsequent step is decreased. Hence, the final rolling temperature is set in the range of from 650° C. to 900° C. and preferably in the range of from 700° C. to 800° C.

In addition, in the final rolling, when the reduction in thickness at a rolling temperature of 650° C. to 900° C. is less than 20%, {100}//ND, a large amount of {100}//ND colony remains which causes decrease in r value and generation of ridging. In the present invention, the {100}//ND means that an <100> orientation vector of a crystal is parallel to an orientation vector (ND orientation) perpendicular to the rolling surface. In addition, the {100}//ND colony is an assembly of adjacent crystals in which the angle formed of each <100> orientation vector with the orientation vector (ND orientation) perpendicular to the rolling surface is within 30°. On the other hand, when the reduction in thickness is more than 40%, biting defects and shape defects may occur, and as a result, steel surface properties may be deteriorated. Accordingly, in the final rolling, at least one pass of rolling at a reduction in thickness of 20% to 40% is performed. The preferable range is 25% to 35%. When the final rolling is performed at least one pass under the conditions in which the rolling temperature and the reduction in thickness described above are satisfied, deep drawing properties can be improved. This one pass may be performed at any stage; however, in consideration of a rolling machine capacity, this pass is most preferably performed as the last pass.

(21) Cold Rolling:

As described above, after the annealed steel sheet processed by annealing for the hot-rolled steel sheet is cold-rolled, recrystallization annealing is further performed. The conditions for cold rolling are not specifically limited, and a general method may be used.

Cold rolling may be carried out at least twice whenever necessary with intermediate annealing which is performed therebetween at a temperature of 600° C. to 900° C. In this case, the total reduction in thickness or a reduction ratio represented by (reduction in thickness of first cold rolling/reduction in thickness of final cold rolling) is preferably set to 75% or more and 0.7 to 1.3, respectively. In addition, grain size number of ferrite grain right before the final cold rolling is set to preferably 6.0 or more, more preferably 6.5 or more, and even more preferably 7.0 or more. When the intermediate annealing temperature is less than 600° C., recrystallization insufficiently occurs, and in addition to decrease in r value, the ridging apparently occurs due to non-recrystallized band-shaped structure. On the other hand, when the intermediate annealing temperature is more than 900° C., an intermediate-annealed steel sheet structure becomes large and coarse, Ti base carbides and Ti base phosphides are redissolved, and as a result, the Ti base precipitates cannot be maintained to have a predetermined size. Furthermore, C and P in a solid solution form are increased in steel, and hence the formation of structures having suitable deep drawing properties is interfered with. The increase in total reduction in thickness has an influence on the improvement in development of the {111} textures of the final-annealed steel sheet, and in addition, the r value is advantageously improved.

Furthermore, in cold rolling in the present invention, it is preferable that by using a tandem rolling machine, the cold rolling is preferably performed in one direction with a work roll having a roll diameter of 300 mm or more. In order to suppress shear deformation of a material to be rolled and to increase (222)/(200) for improving the r value, the influences of the roll diameter and rolling direction are preferably taken into consideration. In general, in the final cold rolling for stainless steel, in order to obtain surface gloss, a work roll having a small roll diameter, such as 200 mm diameter or less, has been used; however, according to the present invention, since it is particularly intended to improve the r value, even in the final cold rolling, a work roll having a large roll diameter of 300 mm or more is preferably used.

That is, compared to reverse rolling using a roll having a diameter of 100 to 200 mm, when tandem rolling is used in which rolling is performed in one direction using a roll having a diameter of 300 mm or more, the shear deformation on surfaces is decreased, and the r value is advantageously improved. Since the large diameter roll is used as a work roll for rolling, and in addition, one direction rolling (tandem rolling) is performed, the (222) is increased. In order to stably obtain a higher r value, a line pressure (rolling load/sheet width) must be increased so that a strain is uniformly applied in the thickness direction, and hence it is effective that decrease in hot rolling temperature, higher alloying, increase in hot rolling speed be optionally combined with each other.

According to the present invention, as described above, P is allowed to remain at a content of from 0.01% to 0.04% in steel, the P being particularly likely to be contained in starting materials used for steel manufacturing, so as to be precipitated in the form of Ti base precipitates having a predetermined size. Hence, the precipitates are made harmless, and suppression of grain growth by an appropriate pinning effect of the precipitates and higher purification of the matrix can be achieved. As a result, compared to steel in which purification is performed simply by refining so as to form fine precipitates or so as to suppress the precipitation itself, steel having fine grains and a low yield strength can be obtained. According to the present invention, a ferritic stainless steel sheet having a low yield strength can be manufactured in which the ductility, ridging, and anisotropy of mechanical properties are also improved.

When a pipe is formed by welding using the steel sheet of the present invention described above, welding methods are not particularly limited, and for example, general arc welding methods such as MIG (Metal Inert Gas), MAG (Metal Active Gas), and TIG (Tungsten Inert Gas); resistance welding methods such as spot welding and seam welding; high-frequency resistance welding such as electric resistance welding; and high-frequency induction welding may be used.

Hereinafter, preferred embodiments of the present invention will be described in detail with reference to examples.

EXAMPLE 1

Tables 3 and 4

Steel formed from steel slabs 1 to 4 having compositions (balance being substantially Fe) including P and the like shown in Table 3 was hot-rolled under the following conditions (a slab heating temperature of 1,100° C., a rough rolling temperature of 990° C., a reduction in thickness of rough rolling of 35%, a final rolling temperature of 752° C., and a reduction in thickness of final rolling of 30%), followed by annealing of the hot-rolled steel sheet under the following conditions (a box annealing temperature of 780° C., a holding time for box annealing of 10 hours, an intermediate annealing temperature of 850° C., a total reduction in thickness of 85%, a reduction ratio of 1.0, and a final annealing temperature of 900° C., thereby forming hot-rolled steel sheets. In addition, as for the steel 3, in a rolling step in which the thickness was further gradually decreased to 5 mm, 2.3 mm, and 0.8 mm, three times annealing including intermediate annealing, cold rolling by a two-time cold rolling method, and final rolling were performed. In addition, for each of the precipitation nose temperatures T of Ti precipitates of the steel slabs 1 to 4 in Table 3, precipitated Ti amounts were measured at various annealing temperatures (500° C. to 1,000° C. at regular intervals of 25° C.) and for various annealing times (1 minute, 10 minutes, 1 hour, and 100 hours), and a precipitation curve was obtained in which the precipitated Ti amount was at least 50% of the total Ti content in the steel sheet. In addition, the temperature T corresponding to the nose portion N shown in FIG. 4 was defined as a precipitation nose temperature T (° C.) of the Ti base precipitates (carbides, phosphides, and the like). The precipitation nose temperatures T thus obtained are shown in Table 3.

The properties of the hot-rolled steel sheets and the cold-rolled steel sheets were investigated. The results are shown in Table 4. The grain size numbers of ferrite grains of the hot-rolled steel sheet and the final-annealed steel sheet were measured on a cross-section in the rolling direction (L direction) by a section method in accordance with JIS G0552. In addition, by using a test piece JIS No. 13-B, YS, TS, and El. of the hot-rolled annealed steel sheets and the cold-rolled annealed steel sheets were measured. In addition, a mono-axial tensile stress of 15% was applied beforehand, and the r values (rL, rD, rC) in individual directions were obtained in accordance with the three point method. Subsequently, the average r value and Δr were calculated by the following equations, and the average values were obtained when the number of data points n was 3.

$$\text{Average } r=(rL+2rD+rC)/4,$$

$$\Delta r=(rL-2rD+rC)/2.$$

(Where rL, rD and rC represent, respectively, r values in the rolling direction, in a direction of 45° with respect to the rolling direction, and in a direction of 90° with respect to the rolling direction.)

In addition, an undulation height of a steel sheet surface, which indicated the resistance to generation of rough surface, was measured by the steps of forming a test piece JIS No. 5 by cutting the steel sheet along the rolling direction, processing the test piece by #800 wet polishing, applying a tensile strain of 25%, and measuring the roughness generated on the surface along a length of 1 cm in the direction perpendicular to the tensile direction using a stylus method, and the evaluation was performed using the value (Ry) of the surface roughness. In this measurement, 5 points were measured in the range of ±10 mm from the center of the test piece in the longitudinal direction at regular intervals of 5 mm in the longitudinal direction, and up to 10 data of the average roughness were obtained.

The ridging resistance was measured by the steps of forming a test piece JIS No. 5 by cutting the steel sheet along the rolling direction, processing two surfaces of the test piece by a wet polishing paper of #600, applying a tensile strain of 25%, and measuring undulation heights of the center of the test piece in the tensile direction and in the direction perpendicular thereto using a surface roughness meter, and the undulation heights thus measured were categorized into the following five ranks A to E for evaluation. The rank A indicates an undulation height of 15 μm or less, the rank B indicates an undulation height of 30 μm or less, the rank C indicates an undulation height of 45 μm or less, the rank D indicates an undulation height of 60 μm or less, and the rank E indicates an undulation height of more than 60 μm.

When the ridging is categorized into the ranks C, D, and E, although the r value and the ductility are improved, due to the irregularities of the ridging, the decrease in workability limit occurs; hence, the ranks A and B are regarded as an acceptable level. In addition, the load required for refining was evaluated based on the time required for refining. In this evaluation, a refining time required for reducing the P content in molten steel to 0.015% is regarded as the standard, in which recycling of scrap, dust, and slag is not performed; the case in which the refining time is 150% or more of the standard time is categorized as non-acceptable level C; the case in which the refining time is more than 70% to less than 150% is categorized as acceptable level B; and the case in which the refining time is decreased to 70% or less is categorized as acceptable level A. When dust and slag generated in refining are recycled, the P amount contained into molten steel is increased, and as a result, the refining load is increased.

The ratio of precipitation in the form of the Ti base precipitates to the total Ti content in each of the hot-rolled annealed steel sheet and the cold-rolled annealed steel sheet was obtained by multiplying 100 and an analyzed amount (mass percent) of a precipitated Ti in steel divided by the total Ti content (mass percent) therein. "The total Ti amount (mass percent)" was measured in accordance with JIS G1258:1999 (Iron and steel-Methods for inductively coupled plasma atomic emission spectrometry). That is, a sample is dissolved in an acid (hydrochloric acid+nitric acid). After a residue is recovered by filtration and is processed by an alkaline fusion (sodium carbonate+sodium borate), the residue thus processed is dissolved in hydrochloric acid and is mixed together with the acid solution mentioned above, and the mixture thus obtained is diluted with purified water to a predetermined volume. Subsequently, by an ICP emission spectrometer, the Ti amount (TiA) in this solution is quantified.

$$\text{Total Ti amount (mass percent)} = \text{TiA/sample weight} \times 100$$

"The precipitated Ti amount (mass percent)" is obtained by constant-current electrolysis (current density of 20 mA/cm$^2$ or less) of a sample using an acetyl acetone base electrolyte (a so-called AA solution). A residue in the electrolyte after this electrolysis is recovered by filtration and is processed by an alkaline fusion (sodium peroxide+lithium methaborate), and then the residue thus processed is dissolved by acid and is diluted with purified water to a predetermined volume. Subsequently, by an ICP emission spectrometer, the Ti amount (TiB) in this solution is quantified.

$$\text{Precipitated Ti amount (mass percent)} = \text{TiB/sample weight} \times 100$$

In addition, the ratio of precipitation in the form of the Ti base precipitates to the total P content in each of the hot-rolled annealed steel sheet and the cold-rolled annealed steel sheet was obtained by multiplying 100 and an analyzed amount (mass percent) of a precipitated P in steel divided by the total P content (mass percent) therein. "The total P amount (mass percent)" was quantitatively measured in accordance with JIS G1214:1998 (Iron and steel Methods for determination of phosphorus content). That is, a sample is dissolved in an acid (nitric acid+hydrochloric acid+perchloric acid), and phosphorus is then processed by white fume treatment using perchloric acid to form orthophosphoric acid, followed by the formation of a complex with molybdic acid. Subsequently, by molybdophosphoric acid-blue complex (molybdenum blue) absorption spectroscopy, the P amount (PA) in this solution is quantified.

$$\text{Total P amount (mass percent)} = \text{PA/sample weight} \times 100$$

On the other hand, "the precipitated P amount (mass percent)" is obtained by constant-current electrolysis (current density of 20 mA/cm$^2$ or less) of a sample using an acetyl acetone base electrolyte (a so-called AA solution). A residue in the electrolyte after this electrolysis is recovered by filtration and is dissolved in an acid (nitric acid+hydrochloric acid+perchloric acid), and then phosphorus is processed by white fume treatment using perchloric acid to form orthophosphoric acid, followed by the formation of a complex with molybdic acid. Subsequently, by molybdophosphoric acid blue (molybdenum blue) absorption spectroscopy, the P amount (PB) in this solution is quantified.

$$\text{Precipitated P amount (mass percent)} = \text{PB/sample weight} \times 100$$

Figure 1:
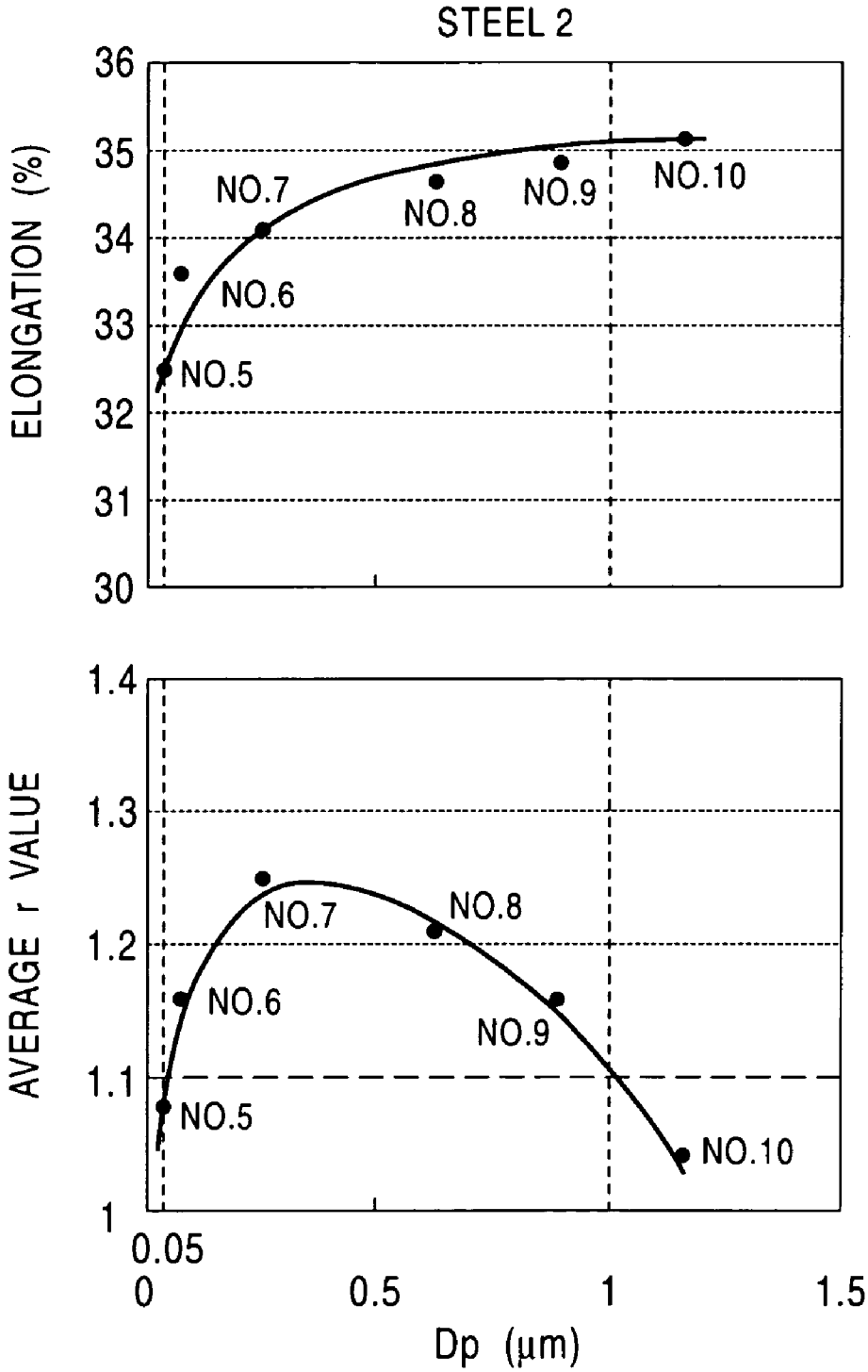
FIG. 1 is a graph showing the relationship of an average diameter Dp (μm) of Ti base precipitates with an average r value and the elongation (%)
Figure 2:
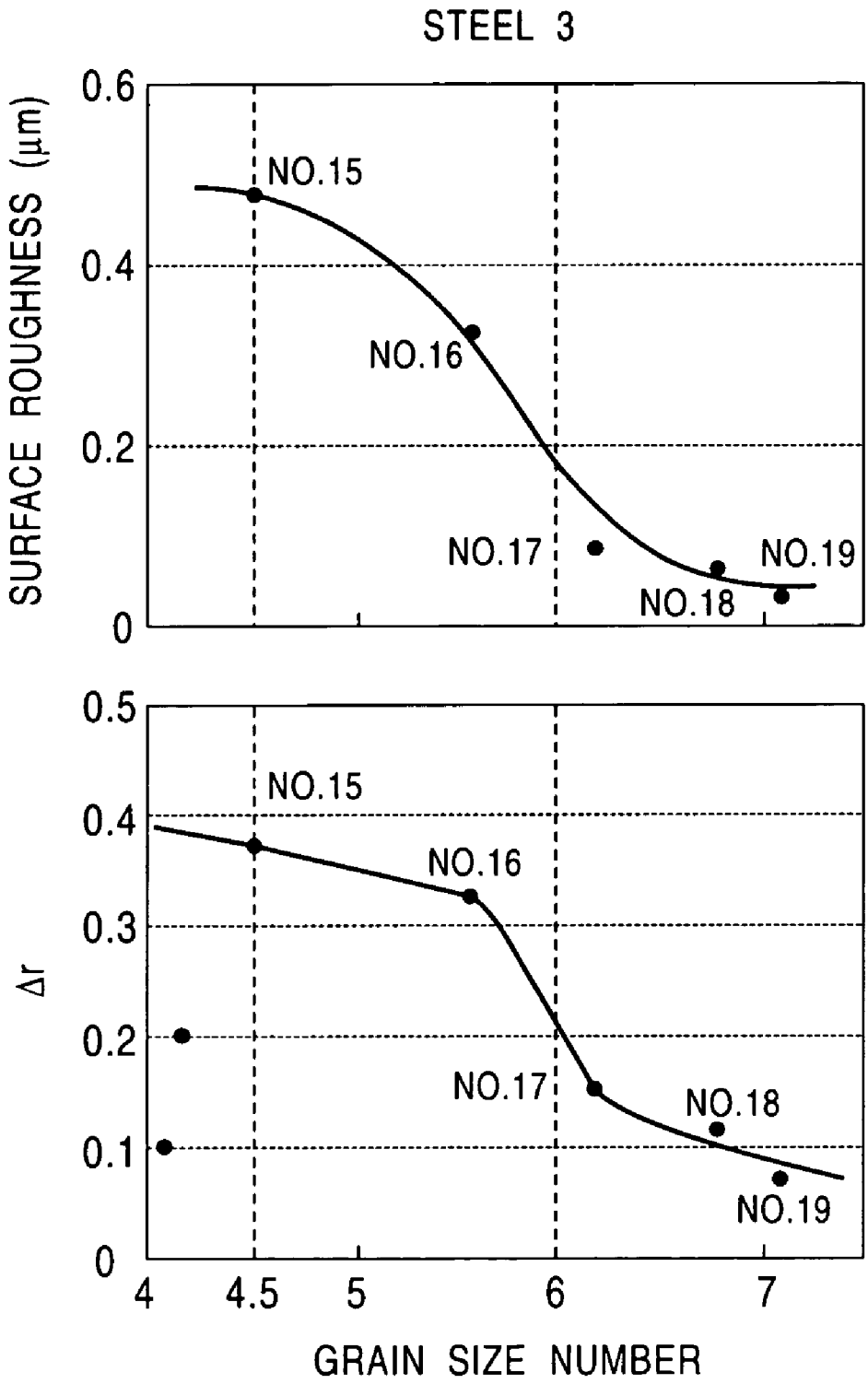
FIG. 2 is a graph showing the relationship of a grain size number (Gs. No.) of a cold-rolled annealed steel sheet with Δr (anisotropy) and surface roughness (μm) thereof.

The results are shown in Table 4. In FIG. 1, as for Nos. 5 to 10, the relationship among the average diameter Dp of the Ti base precipitates, the average r value, and the ductility El. is shown. In addition, in FIG. 2, as for Nos. 15 to 19, the relationship among the average diameter Dp of the Ti base precipitates, the Δr value (anisotropy), and the surface roughness is shown. From FIG. 1, in the relationship between the average diameter Dp of the precipitates and the average r value, it was understood that the maximum value is obtained at a Dp of approximately 0.03 μm, and that the Dp is effectively controlled in the range of from 0.05 μm to 1.0 μm so as to obtain an average r value of 1.1 or more of the hot-rolled steel sheet. FIG. 2 shows the influences of the grain size number of the cold-rolled annealed steel sheet on the surface roughness and the Δr thereof by way of example. It was understood that when the grain size number of the cold-rolled annealed steel sheet is 6.0 or less, the surface roughness is drastically increased, and in addition, that the anisotropy (Δr) of the r value is also increased.

Hereinafter, the results shown in Table 4 will be described.

No. 1 is a comparative example in which the refining time was short. In this comparative example, the p content was not sufficiently reduced by refining, such as 0.046%; hence, the ductility El. and the average r value were low, and the YS and TS were high.

Nos. 2 and 3 are examples in which P was decreased to 0.04% or less. In the examples of the present invention, since the P was decreased, the ductility El. and the average r value were high, and the YS and TS were low.

No. 4 is an example in which P was decreased to 0.008%. In this comparative example, although the properties of the steel were improved, the time required for refining was long.

No. 5 is a comparative example in which the average diameter Dp of the Ti base precipitates was small, such as 0.03 μm, the YS was high, the average r value was low, and the workability was not good.

Nos. 6 to 9 are examples in which the average diameter Dp of the Ti base precipitates was grown larger and coarser, such as 0.07 μm to 0.88 μm, and in which the hot-rolled steel sheets were formed uniformly so that the grain size number were the same, such as 6.1. These examples of the present invention show that, compared to the result of No. 5, the workability (YS was low, and elongation was high) was improved as the average diameter Dp of the Ti base precipitates was increased in the range described above.

No. 10 is a comparative example in which since the average diameter Dp of the Ti base precipitates was 1.15 μm, which was more than an upper limit of 1.0 μm according to the present invention, the average r value was decreased.

Nos. 11 and 12 are comparative examples in which since the grain size of the hot-rolled steel sheet from the steel 2 was less than 6.0, the ductility El. and the average r value were insufficient, the Δr was large, and the ridging ranks were the D and C ranks.

Nos. 13 and 14 are examples of the present invention in which since the grain size number of the hot-rolled steel sheet from the steel 2 was very decreased, such as 6.5 and 7.1, the average r value was particularly improved, the Δr was decreased, and the workability was improved.

Nos. 15 and 16 are comparative examples in which the grain size number of the cold-rolled steel sheet was grown large and coarse, such as 4.5 and 5.6, the average r value was large, the ridging was categorized in the D and C ranks, and the workability was degraded.

Nos. 17, 18 and 19 are examples of the present invention in which since the average diameter Dp of the Ti base precipitates, the grain size number of the hot-rolled steel sheet, and the grain size number of the cold-rolled steel sheet were controlled, the average r value was high, and superior workability was obtained.

EXAMPLE 2

Tables 5 and 6

Steel slabs having 10 types of component compositions (steel 5 to steel 14) shown in Table 5 which contained various P contents were heated and then hot-rolled to form hot-rolled steel sheets having a thickness of 4 mm. In this example, the precipitation nose temperature T (° C) of the Ti base precipitates and the ratio of the precipitated amounts of Ti and P were obtained in the same manner as that in Example 1. Subsequently, the hot-rolled steel sheet was processed by recrystallization annealing at a temperature different from the precipitation nose temperature T as shown in Table 6, and the Ti base precipitates having the average diameter Dp shown in Table 6 were precipitated. Next, cold rolling was performed at a total reduction in thickness of 80% to form a cold-rolled steel sheet having a thickness of 0.8 mm, and final annealing (annealing of the cold-rolled steel sheet) was then performed at a temperature different from the precipitation nose temperature T as shown in Table 6. As for the cold-rolled steel sheets thus formed, the grain size, the properties (YS, TS, El, and r), the ridging, the precipitation ratios of Ti and P, and the refining time were measured in the same manner as that in Example 1. The results are shown in Table 6.

No. 20 is a comparative example in which the P content was high, such as 0.046%, and the inappropriate steel 5 was used having a component system outside of the JIS standards. When the P content was too high, although the Ti base precipitates of the hot-rolled steel sheet were grown large and coarse, the YS was 340 MPa, that is, the high hardness was not changed.

Nos. 21 to 23 are examples of the present invention in which the appropriate steel 6 to 8 were used. In the examples, when the average diameter Dp of the Ti base precipitates was set to 0.15 μm to 0.25 μm, although the average diameter Dp indicated very fine grains, a low yield strength, a high elongation El. and a high r value were simultaneously obtained.

No. 24 is a comparative example in which the inappropriate steel 9 was used having a decreased P content of 0.008%. When the P content was so much decreased as described above, although the YS was low, in addition to the increase in anisotropy Δr, the time required for refining became longer than that in the past. In addition, when scrap is used in view of recycling, there will be a serious limitation.

As is No. 20, No. 25 is a comparative example in which the inappropriate steel 10 was used having a high P content of 0.042%. Accordingly, the YS was high, and other mechanical properties were also inferior.

Nos. 26 and 27 are examples of the present invention using the appropriate steel 11 and 12 in which since the average grain diameters Dp of the Ti base precipitates were set to 0.22 μm and 0.25 μm, the workability was improved.

No. 28 is a comparative example using the inappropriate steel 13 in which the P content was decreased to 0.005%. In this case, the properties of the steel were improved; however, the anisotropy Δr was increased by grain growth as was expected, and the refining time required for reducing the content to 0.005% was very disadvantageously increased. Hence, in view of a recycling process, there is a serious disadvantage.

Nos. 29 and 30 are comparative examples using the appropriate steel 7 in which the hot-rolled steel sheet was annealed under an annealing condition outside the range of (a precipitation nose temperature of Ti±50° C.). In No. 29 in which annealing was performed at a temperature much higher than the precipitation nose temperature T, recrystallization was advantageously promoted; however, the amounts of C and P in a solid solution form were increased, and in addition, the size of the Ti base precipitates became smaller. As a result, the material was hardened due to solid solution reinforcement and precipitation reinforcement. On the other hand, in No. 30 in which the annealing temperature was lower than the precipitation nose temperature T−70° C., the structure would not be recrystallized at all, or grains would be grown while part of the structure would remain in a non-recrystallized state. Furthermore, since the size of the precipitates is small, superior steel properties could not be obtained.

No. 31 is a comparative example in which the Ti base precipitates in the hot-rolled annealed steel sheet were grown large and coarse to have an average diameter Dp of 1.11 μm. When the precipitates were grown large and coarse to have an average diameter Dp of more than 1.0 μm, the ductility El. and the average r value were decreased.

No. 32 is a comparative example in which the Ti base precipitates in the hot-rolled annealed steel sheet was grown smaller so as to have an average diameter Dp of 0.03 μm. According to the relationship between the average diameter Dp and the yield strength, for example, compared to the case of No. 22 in which the average diameter Dp in the Ti base precipitates was large, the yield strength was large.

No. 33 is an example in which the final annealing temperature was set to the precipitation nose temperature T+130° C. When the final temperature was increased, the Ti base phosphides were redissolved, and hardening occurred.

No. 34 is an example of the present invention in which the precipitation nose temperature T−100° C. was satisfied, and in which the ferrite grain size number of the cold-rolled annealed steel sheet was 6.0 or more.

No. 35 is a comparative example in which since the grain size number of the cold-rolled steel sheet was less than 6.0, such as 5.8, the surface roughness became apparent, and in which the ridging was categorized in the rank C.

No. 36 is an example in which grains of the cold-rolled annealed steel sheet were grown large and coarse so that the ferrite grain size number was less than 6.0. When the grain diameter of the final-annealed steel sheet was grown large and coarse, the surface roughness became apparent in processing, and the workability was degraded.

No. 37 is an example in which Ti/(C+N) was 5.55 which was much lower than a lower limit of 8 defined in the present invention. As the steel was hardened, and as the ductility El thereof was degraded, the generation of ridging apparently occurred.

INDUSTRIAL APPLICABILITY

According to the present invention, in manufacturing a Ti-containing ferritic stainless steel sheet having a low yield strength, when a large amount of P and C remaining in molten steel due to recycling of slag, dust, scrap, and the like is grown in the form of large and coarse Ti base precipitates so as to be harmless materials, a Ti-containing ferritic stainless steel sheet having superior ductility and a low YS can be obtained as compared to a conventional material having the same crystal grain size as that of the steel sheet of the present invention. In addition, since existing machines can be used for manufacturing, recycling and energy saving can be advantageously achieved.

TABLE 1

| Chemical Composition(mass) | | | | | | | | | | | |
|---|---|---|---|---|---|---|---|---|---|---|---|
| C | Si | Mn | P | S | Cr | Ni | N | Mo | Al | Ti | Ti/(C + N) |
| 0.003 | 0.08 | 0.24 | 0.024 | 0.002 | 15.9 | 0.11 | 0.006 | 0.01 | 0.01 | 0.166 | 18.4 |

TABLE 2

| | Hot-rolled annealed steel sheet | | |
|---|---|---|---|
| Sample No. | Grain size number (Gs No.) | Average diameter Dp of Ti base precipitates Dp (μm) | Cold-rolled annealed steel sheet Vield strength (MPa) |
| A | 5.59 | 0.28 | 234 |
| B | 6.04 | 0.28 | 242 |
| C | 6.46 | 0.28 | 244 |
| D | 6.82 | 0.28 | 246 |
| E | 7.35 | 0.28 | 257 |
| F | 5.75 | 0.03 | 250 |
| G | 6.18 | 0.03 | 260 |
| H | 6.71 | 0.03 | 265 |
| I | 7.00 | 0.03 | 274 |
| J | 7.36 | 0.03 | 280 |

TABLE 3

| Steel | Chemical composition (mass %) C | Si | Mn | P | S | Cr | Ni | N | Mo | Al | Ti | Ti/(C + N) | Nose temperature of Ti base precipitates | Remarks |
|---|---|---|---|---|---|---|---|---|---|---|---|---|---|---|
| 1 | 0.004 | 0.10 | 0.25 | 0.046 | 0.003 | 16.2 | 0.11 | 0.008 | 0.01 | 0.02 | 0.159 | 13.3 | 770 | Comparative example |
| 2 | 0.004 | 0.10 | 0.24 | 0.038 | 0.003 | 16.1 | 0.12 | 0.008 | 0.01 | 0.02 | 0.161 | 13.4 | 760 | Example |
| 3 | 0.005 | 0.11 | 0.25 | 0.013 | 0.003 | 16.1 | 0.11 | 0.008 | 0.01 | 0.02 | 0.160 | 12.3 | 740 | Example |
| 4 | 0.005 | 0.10 | 0.25 | 0.008 | 0.003 | 16.2 | 0.11 | 0.008 | 0.01 | 0.02 | 0.155 | 11.9 | 730 | Comparative example |

TABLE 4

| Number | Steel | Average diameter Dp of Ti base precipitates μm | Grain size number of hot-rolled steel sheet | Ratio (%) of precipitated Ti to total Ti (mass %) | Ratio (%) of precipitated P to total P (mass %) | Grain size number of cold-rolled steel sheet | YS MPa | TS MPa | El % | Average r value | Δ r | Ridging rank | Surface roughness μm | Refining time | Remarks |
|---|---|---|---|---|---|---|---|---|---|---|---|---|---|---|---|
| 1 | 1 | 0.12 | 6.1 | 60 | 72 | — | 280 | 444 | 31.8 | 1.05 | 0.21 | B | 0.08 | A | Comparative example |
| 2 | 2 | 0.10 | 6.2 | 71 | 75 | — | 263 | 429 | 34.1 | 1.15 | 0.13 | B | 0.10 | B | Example |
| 3 | 3 | 0.11 | 6.2 | 69 | 71 | — | 250 | 422 | 35.3 | 1.22 | 0.13 | B | 0.07 | B | Example |
| 4 | 4 | 0.12 | 6.0 | 55 | 59 | — | 243 | 418 | 35.6 | 1.24 | 0.14 | B | 0.08 | C | Comparative example |
| 5 | 2 | 0.03 | 6.0 | 40 | 33 | — | 281 | 450 | 32.5 | 1.08 | 0.11 | B | 0.08 | B | Comparative example |
| 6 | 2 | 0.07 | 6.1 | 61 | 72 | — | 265 | 432 | 33.6 | 1.16 | 0.13 | B | 0.09 | B | Example |
| 7 | 2 | 0.25 | 6.1 | 72 | 55 | — | 255 | 430 | 34.1 | 1.25 | 0.15 | B | 0.11 | B | Example |
| 8 | 2 | 0.61 | 6.1 | 75 | 65 | — | 253 | 429 | 34.6 | 1.21 | 0.15 | B | 0.11 | B | Example |
| 9 | 2 | 0.88 | 6.1 | 60 | 73 | — | 251 | 429 | 34.8 | 1.16 | 0.17 | B | 0.09 | B | Example |
| 10 | 2 | 1.15 | 6.1 | 65 | 68 | — | 248 | 425 | 35.1 | 1.04 | 0.15 | B | 0.09 | B | Comparative example |
| 11 | 2 | 0.28 | 4.5 | 62 | 65 | — | 245 | 420 | 31.4 | 1.04 | 0.41 | D | 0.45 | B | Comparative example |
| 12 | 2 | 0.24 | 5.5 | 55 | 52 | — | 252 | 428 | 34.9 | 1.2 | 0.31 | C | 0.25 | B | Comparative example |
| 13 | 2 | 0.25 | 6.5 | 58 | 61 | — | 259 | 433 | 34.2 | 1.27 | 0.17 | B | 0.07 | B | Example |
| 14 | 2 | 0.27 | 7.1 | 80 | 92 | — | 260 | 435 | 33.8 | 1.31 | 0.08 | B | 0.05 | B | Example |
| 15 | 3 | 0.11 | 6.2 | 61 | 70 | 4.5 | 243 | 425 | 30.8 | 1.69 | 0.37 | D | 0.48 | B | Comparative example |
| 16 | 3 | 0.11 | 6.2 | 55 | 55 | 5.6 | 255 | 432 | 34.8 | 1.9 | 0.32 | C | 0.32 | B | Comparative example |
| 17 | 3 | 0.11 | 6.2 | 62 | 91 | 6.2 | 257 | 435 | 34.3 | 2.03 | 0.15 | B | 0.08 | B | Example |
| 18 | 3 | 0.11 | 6.2 | 55 | 80 | 6.8 | 259 | 438 | 33.8 | 2.01 | 0.11 | B | 0.06 | B | Example |
| 19 | 3 | 0.11 | 6.2 | 55 | 71 | 7.1 | 262 | 439 | 33.1 | 1.88 | 0.07 | A | 0.03 | B | Example |

TABLE 5

| Steel | Chemical composition (mass %) C | Si | Mn | P | S | Cr | Ni | N | Mo | Al | Ti | Ti/(C + N) | Nose temperarure of Ti base precipitates (° C.) | Remarks |
|---|---|---|---|---|---|---|---|---|---|---|---|---|---|---|
| 5 | 0.004 | 0.10 | 0.25 | 0.046 | 0.003 | 16.2 | 0.11 | 0.008 | 0.01 | 0.02 | 0.159 | 13.3 | 770 | Inappropriate steel |
| 6 | 0.004 | 0.10 | 0.24 | 0.038 | 0.002 | 16.1 | 0.12 | 0.008 | 0.01 | 0.02 | 0.161 | 13.4 | 760 | Appropriate steel |
| 7 | 0.003 | 0.08 | 0.24 | 0.024 | 0.002 | 15.9 | 0.11 | 0.006 | 0.01 | 0.01 | 0.166 | 18.4 | 750 | Appropriate steel |
| 8 | 0.005 | 0.11 | 0.25 | 0.013 | 0.003 | 16.1 | 0.11 | 0.008 | 0.01 | 0.02 | 0.160 | 12.3 | 740 | Appropriate steel |
| 9 | 0.005 | 0.10 | 0.25 | 0.008 | 0.003 | 16.2 | 0.11 | 0.008 | 0.01 | 0.02 | 0.155 | 11.9 | 730 | Inappropriate steel |
| 10 | 0.007 | 0.25 | 0.31 | 0.042 | 0.002 | 11.2 | 0.25 | 0.009 | 0.17 | 0.03 | 0.250 | 15.6 | 730 | Inappropriate steel |
| 11 | 0.007 | 0.24 | 0.30 | 0.031 | 0.002 | 11.2 | 0.24 | 0.008 | 0.18 | 0.03 | 0.249 | 16.6 | 720 | Appropriate steel |
| 12 | 0.006 | 0.25 | 0.31 | 0.014 | 0.002 | 11.1 | 0.25 | 0.008 | 0.18 | 0.03 | 0.244 | 17.4 | 700 | Appropriate steel |
| 13 | 0.007 | 0.25 | 0.30 | 0.005 | 0.002 | 11.2 | 0.25 | 0.007 | 0.17 | 0.03 | 0.250 | 17.9 | 690 | Inappropriate steel |
| 14 | 0.110 | 0.08 | 0.26 | 0.033 | 0.002 | 16.3 | 0.11 | 0.006 | 0.01 | 0.01 | 0.050 | 5.55 | 760 | Inappropriate steel |

TABLE 6

| Number | Steel | Temperature difference of annealing temperature of hot-rolled steel sheet from T ° C. | Average diameter Dp of Ti base precipitates μm | Ratio(%)of precipitated Ti to total Ti(mass %)(hot-rolled steel sheet) | Ratio(%)of precipitated Ti to total P(mass %)(hot-rolled steel sheet) | Temperature difference of annealing Temperature of cold-rolled steel sheet from T ° C. | Grain size number of cold-rolled steel sheet (Gs No.) |
|---|---|---|---|---|---|---|---|
| 20 | 5 | +20 | 0.30 | 55 | 55 | +35 | 6.8 |
| 21 | 6 | ±0 | 0.25 | 80 | 70 | +30 | 6.7 |
| 22 | 7 | ±0 | 0.15 | 86 | 75 | +30 | 7.0 |
| 23 | 8 | ±0 | 0.18 | 88 | 95 | +30 | 6.9 |
| 24 | 9 | ±0 | 0.04 | 80 | 80 | +30 | 6.9 |
| 25 | 10 | ±0 | 0.15 | 88 | 75 | +30 | 7.2 |
| 26 | 11 | ±0 | 0.22 | 82 | 88 | +30 | 7.1 |
| 27 | 12 | ±0 | 0.25 | 75 | 65 | +30 | 6.9 |
| 28 | 13 | ±0 | 0.03 | 89 | 80 | +30 | 6.8 |
| 29 | 7 | +60 | 0.03 | 30 | 25 | +30 | 6.7 |
| 30 | 7 | −70 | 0.02 | 36 | 40 | +30 | 6.9 |
| 31 | 7 | ±0 | 1.11 | 70 | 80 | +10 | 6.9 |
| 32 | 7 | ±0 | 0.03 | 80 | 75 | +40 | 7.0 |
| 33 | 7 | ±0 | 0.22 | 75 | 68 | +130 | 6.5 |
| 34 | 7 | ±0 | 0.22 | 68 | 80 | +60 | 6.8 |
| 35 | 7 | ±0 | 0.22 | 66 | 95 | +20 | 5.8 |
| 36 | 7 | ±0 | 0.22 | 90 | 88 | +30 | 5.0 |
| 37 | 14 | ±0 | 0.13 | 68 | 70 | +30 | 6.6 |

| Number | Ratio(%)of precipitated Ti to total Ti(mass %) (Cold-rolled steel sheet) | Ratio(%)of precipitated Ti to total P(mass %) (Cold-rolled steel sheet) | YS MPa | TS MPa | El % | Average r value | Δ r | Ridging rank | Refining time | Remarks |
|---|---|---|---|---|---|---|---|---|---|---|
| 20 | 40 | 40 | 340 | 490 | 27 | 1.4 | 0.21 | B | A | Comparative example |
| 21 | 75 | 65 | 273 | 450 | 35 | 1.8 | 0.19 | B | B | Example |
| 22 | 83 | 70 | 265 | 444 | 35 | 1.9 | 0.22 | B | B | Example |
| 23 | 65 | 88 | 255 | 435 | 35 | 1.7 | 0.23 | B | B | Example |
| 24 | 70 | 75 | 258 | 439 | 32 | 1.6 | 0.50 | B | C | Comparative example |
| 25 | 80 | 68 | 325 | 480 | 31 | 1.5 | 0.19 | B | A | Comparative example |
| 26 | 75 | 68 | 246 | 426 | 37 | 1.9 | 0.24 | B | B | Example |
| 27 | 68 | 59 | 240 | 420 | 40 | 2.1 | 0.24 | B | B | Example |
| 28 | 86 | 75 | 243 | 422 | 35 | 1.9 | 0.55 | B | C | Comparative example |
| 29 | 50 | 43 | 280 | 450 | 34.5 | 1.6 | 0.22 | B | B | Comparative example |
| 30 | 40 | 45 | 320 | 500 | 34.3 | 1.2 | 0.13 | C | B | Comparative example |
| 31 | 60 | 90 | 248 | 418 | 29 | 1.18 | 0.55 | B | B | Comparative example |
| 32 | 55 | 75 | 281 | 455 | 34 | 1.55 | 0.21 | B | B | Comparative example |
| 33 | 70 | 65 | 293 | 440 | 35 | 1.66 | 0.29 | B | B | Comparative example |
| 34 | 70 | 80 | 297 | 441 | 34.3 | 1.55 | 0.26 | B | B | Example |
| 35 | 65 | 92 | 241 | 420 | 38 | 1.9 | 0.15 | C | B | Comparative example |
| 36 | 70 | 80 | 237 | 412 | 40 | 2.0 | 0.17 | D | B | Comparative example |
| 37 | 60 | 55 | 285 | 510 | 25 | 1.1 | 0.39 | D | B | Comparative example |

The invention claimed is:

1. A Ti-containing ferritic stainless steel sheet comprising on a mass percent basis: 0.01% or less of C; 0.5% or less of Si; 0.3% or less of Mn; 0.01% to 0.04% of P; 0.01% or less of S; 8% to 30% of Cr; 1.0% or less of Al; 0.05% to 0.5% of Ti; 0.04% or less of N, 8≦Ti/(C+N)≦30 being satisfied; and being free of Nb, with the balance being substantially Fe and incidental impurities, wherein at least 50% of the total P content in the steel sheet is precipitated in the form of the Ti base precipitates, a grain size number of ferrite grain is 6.0 or more, and an average diameter Dp of precipitations, each being [(a long axis length of a Ti base precipitate+a short axis length thereof)/2], of the Ti base precipitates in the steel sheet is in the range of from 0.05 μm to 1.0 μm.

2. The Ti-containing ferritic stainless steel sheet according to claim 1, wherein at least 50% of the total Ti content in the steel sheet is precipitated in the form of the Ti base precipitates.

3. The Ti-containing ferritic stainless steel sheet according to one of claims 1 to 2, wherein the steel sheet is a hot-rolled steel sheet.

4. The Ti-containing ferritic stainless steel sheet according to one of claims 1 to 2, wherein the steel sheet is a cold-rolled steel sheet.

5. A method for manufacturing a Ti-containing ferritic stainless steel sheet comprising the steps of: hot-rolling steel which comprises on a mass percent basis: 0.01% or less of C; 0.5% or less of Si; 0.3% or less of Mn; 0.01% to 0.04% of P; 0.01% or less of S; 8% to 30% of Cr; 1.0% or less of Al; 0.05% to 0.5% of Ti; 0.04% or less of N, $8 \leqq Ti/(C+N) \leqq 30$ being satisfied; and being free of Nb, with the balance being substantially Fe and incidental impurities, for forming a hot-rolled steel sheet, and performing recrystallization annealing of the hot-rolled steel sheet at a temperature of (a precipitation nose temperature of Ti base precipitates±50° C.) so that an average diameter Dp of precipitation diameters, each being [(a long axis length of a Ti base precipitate+a short axis length thereof)/2], of the Ti base precipitates in the steel sheet is in the range of from 0.05 μm to 1.0 μm and so that a grain size number of ferrite grain is 6.0 or more and such that at least 50% of the total P content in the steel sheet is precipitated in the form of the Ti base precipitates.

6. The Ti-containing ferritic stainless steel sheet according to claim 5, wherein at least 50% of the total Ti content in the steel sheet is precipitated in the form of the Ti base precipitates.

7. The method for manufacturing a Ti-containing ferritic stainless steel sheet, according to claim 5, further comprising the steps of: cold-rolling the hot-rolled annealed steel sheet; and subsequently performing final annealing of the cold-rolled steel sheet at a temperature less than (the precipitation nose temperature of Ti base precipitates+100° C.) so that the average diameter Dp of precipitation diameters, each being [(a long axis length of a Ti base precipitate+a short axis length thereof)/2], of the Ti base precipitates is in the range of from 0.05 μm to 1.0 μm and so that the grain size number of ferrite grain is 6.0 or more.

8. The method for manufacturing a Ti-containing ferritic stainless steel sheet, according to claim 7, wherein the final annealing is performed at a temperature less than (the precipitation nose temperature of Ti base precipitates+50° C.).

9. The method for manufacturing a Ti-containing ferritic stainless steel sheet, according to claim 7 or 8, wherein at least 50% of the total Ti content in the steel sheet is precipitated in the form of the Ti base precipitates.

10. The steel according to claim 1, further comprising at least one of 0.3% or less of Ni, 0.3% or less of Cu, 0.3% or less of Co, 0.5% or less of Zr, 0.1% or less of Ca, 0.3% or less of Ta, 0.3% or less of W, 0.3% or less of V, 0.3% or less of Sn, 2.0% or less of Mo and 0.003% or less of Mg.

11. The method according to claim 5, wherein the sheet further comprises at least one of 0.3% or less of Ni, 0.3% or less of Cu, 0.3% or less of Co, 0.5% or less of Zr, 0.1% or less of Ca, 0.3% or less of Ta, 0.3% or less of W, 0.3% or less of V, 0.3% or less of Sn, 2.0% or less of Mo and 0.003% or less of Mg.

* * * * *